US009488436B2

(12) United States Patent
Abst

(10) Patent No.: US 9,488,436 B2
(45) Date of Patent: Nov. 8, 2016

(54) SYSTEM, APPARATUS AND CIRCUITS FOR TACTICAL RAIL ACCESSORY MANAGEMENT

(71) Applicant: Terrill Luis Abst, Oakdale, CA (US)

(72) Inventor: Terrill Luis Abst, Oakdale, CA (US)

( * ) Notice: Subject to any disclaimer, the term of this patent is extended or adjusted under 35 U.S.C. 154(b) by 189 days.

(21) Appl. No.: 14/188,421

(22) Filed: Feb. 24, 2014

(65) Prior Publication Data

US 2014/0245650 A1 Sep. 4, 2014

Related U.S. Application Data

(63) Continuation of application No. PCT/US2012/052387, filed on Aug. 24, 2012.

(60) Provisional application No. 61/527,528, filed on Aug. 25, 2011.

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01)

(58) Field of Classification Search
CPC ..... F41C 27/00; F41G 11/003
USPC ..... 42/84
See application file for complete search history.

(56) References Cited

U.S. PATENT DOCUMENTS 5,481,819 A * 1/1996 Teetzel ..... F41A 9/62 42/117
5,669,174 A * 9/1997 Teetzel ..... F41A 9/62 356/5.01
5,822,905 A * 10/1998 Teetzel ..... F41C 23/16 362/114
6,931,775 B2 * 8/2005 Burnett ..... F41C 27/00 42/106
7,243,454 B1 * 7/2007 Cahill ..... F41C 23/12 42/72
7,260,910 B2 * 8/2007 Danielson ..... F41G 1/35 362/114
7,264,369 B1 * 9/2007 Howe ..... F41G 1/35 200/50.32
7,273,292 B2 * 9/2007 Kim ..... F41G 1/34 362/110
7,464,495 B2 * 12/2008 Cahill ..... F41C 23/12 42/72
7,730,820 B2 * 6/2010 Vice ..... F41C 23/22 42/70.01
7,818,910 B2 * 10/2010 Young ..... F41C 23/16 42/106
7,841,120 B2 * 11/2010 Teetzel ..... F41A 23/08 42/72

(Continued)

FOREIGN PATENT DOCUMENTS

WO 2011/085295 A1 7/2011
WO 2013/029022 A2 2/2013

OTHER PUBLICATIONS

Korean Intellectual Property Office, International Search Report and Written Opinion, issued on Feb. 14, 2013, for corresponding International Patent Application No. PCT/US2012?052387 (pp. 1-13) with Claims Searched (pp. 14-22) pp. 1-22.

*Primary Examiner* — Michelle R Clement
(74) *Attorney, Agent, or Firm* — O'Banion & Ritchey LLP; John P. O'Banion

(57) ABSTRACT

A system, apparatus and circuits for managing one or more electrically powered accessories attached to a firearm having a rail configured for mounting the one or more accessories. The system includes a control module having a housing for fastening the control module to the firearm, a plurality of jacks configured to receive one or more control cords of the one or more accessories and a switch configured to allow selective operation of the one or more accessories. The system may further include a remote activation module and touch detection tab for operating the accessories from a location remote from the control module.

27 Claims, 21 Drawing Sheets

(56) References Cited

U.S. PATENT DOCUMENTS 8,001,715 B2 * 8/2011 Stokes ..... F41C 23/16 362/111
8,091,265 B1 * 1/2012 Teetzel ..... F41C 23/16 42/124
8,225,542 B2 * 7/2012 Houde-Walter ..... F41A 35/00 42/72
8,322,064 B2 * 12/2012 Cabahug ..... F41C 23/22 42/71.01
8,413,362 B2 * 4/2013 Houde-Walter ..... F41C 23/22 42/84
8,443,539 B2 * 5/2013 Cabahug ..... F41C 23/22 42/71.01
8,448,368 B2 * 5/2013 Cabahug ..... F41G 11/003 42/71.01
8,458,944 B2 * 6/2013 Houde-Walter ..... F41A 35/00 42/72
8,516,731 B2 * 8/2013 Cabahug ..... F41C 23/22 42/124
8,776,422 B2 * 7/2014 Dodd ..... F41C 23/22 42/72
8,875,434 B2 * 11/2014 Michal ..... F41C 23/16 42/90
2008/0010890 A1 * 1/2008 Vice ..... F41C 23/16 42/72
2008/0170838 A1 * 7/2008 Teetzel ..... A42B 3/042 386/358
2009/0255160 A1 * 10/2009 Summers ..... F41A 17/063 42/70.01
2010/0020535 A1 * 1/2010 Sharrah ..... F21S 9/02 362/190
2010/0031552 A1 * 2/2010 Houde-Walter ..... F41A 35/00 42/72
2010/0083553 A1 * 4/2010 Montgomery ..... F41C 27/00 42/84
2010/0192443 A1 * 8/2010 Cabahug ..... F41C 23/16 42/71.02
2010/0192444 A1 * 8/2010 Cabahug ..... F41G 11/003 42/71.02
2010/0192446 A1 * 8/2010 Darian ..... F41C 23/22 42/84
2010/0192448 A1 * 8/2010 Darian ..... F41C 23/22 42/84
2010/0218410 A1 * 9/2010 Cabahug ..... F41G 11/003 42/71.01
2010/0242332 A1 * 9/2010 Teetzel ..... F41A 23/08 42/72
2011/0010979 A1 * 1/2011 Houde-Walter ..... F41C 23/22 42/84
2011/0173865 A1 * 7/2011 Compton ..... F41G 11/003 42/84
2012/0266514 A1 * 10/2012 Michal ..... F41C 23/16 42/90
2015/0047246 A1 * 2/2015 Michal ..... F41C 23/16 42/114

* cited by examiner

SYSTEM, APPARATUS AND CIRCUITS FOR TACTICAL RAIL ACCESSORY MANAGEMENT

CROSS-REFERENCE TO RELATED APPLICATIONS

This application is a 35 U.S.C. §111(a) continuation of PCT international application number PCT/US2012/052387 filed on Aug. 24, 2012, incorporated herein by reference in its entirety, which claims the benefit of U.S. provisional patent application Ser. No. 61/527,528 filed on Aug. 25, 2011, incorporated herein by reference in its entirety. Priority is claimed to each of the foregoing applications.

The above-referenced PCT international application was published as PCT International Publication No. WO 2013/029022 on Feb. 28, 2013 and republished on Apr. 18, 2013, which publications are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED IN A COMPUTER PROGRAM APPENDIX

Not Applicable

BACKGROUND OF THE INVENTION

1. Field of the Invention

This invention pertains generally to firearms, and more particularly to an accessory activation controller for firearms.

2. Description of Related Art

In present art guns, the mechanism for activating a laser or other attached electronic device typically involves pressing a button, sliding a switch, using a pressure pad type switch or other type of manual switch. Thus, an additional step is needed to activate a laser aiming device or other electronic device (e.g. a flashlight for illumination, or a video camera for recordkeeping, or the like). Particularly in moments of extreme duress, this extra step complicates and/or delays the act of shooting while potentially providing an adversary a momentary advantage.

Current finger pressure activation devices for weapon mounted flashlights, lasers or other devices are limited in their ability to only activate one, or possibly two devices. Each additional accessory generally requires its own pressure switch which is glued or attached by Velcro® onto the front of the weapon requiring the non-shooting hand to activate the device(s). The need for multiple pressure switches causes insurmountable problems with fastening and positioning the switches onto the weapon for selective or group activation. Multiple pressure switches with multiple cords by their nature are extremely vulnerable to damage, hard to fix into place, control, activate and protect from snagging.

Larger Picatinny Rail systems are being installed that are allowing more devices to be attached to weapons, which are exacerbating an already existing problem with pressure switch placement, control, damage protection and accidental activation of the device.

Therefore, it would be desirable to equip a firearm with multiple ways to activate the laser, to accommodate different scenarios where a soldier, law enforcement officer, or other needs to present his weapon.

Accordingly, an object of the present invention is to provide an apparatus that consolidates the activation of a plurality of firearm accessories with a rail mounted device into which the accessories are plugged for selective activation with the trigger finger alone through a trigger activation switch or a button.

BRIEF SUMMARY OF INVENTION

An aspect of the invention is an apparatus that consolidates the activation of firearm accessories with a Picatinny rail mounted "junction box" into which the accessories are plugged for selective activation with the trigger finger alone through a trigger activation switch or a button.

Another aspect is a remote activation module that controls activation of auxiliary devices.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF INVENTION

Figure 1:
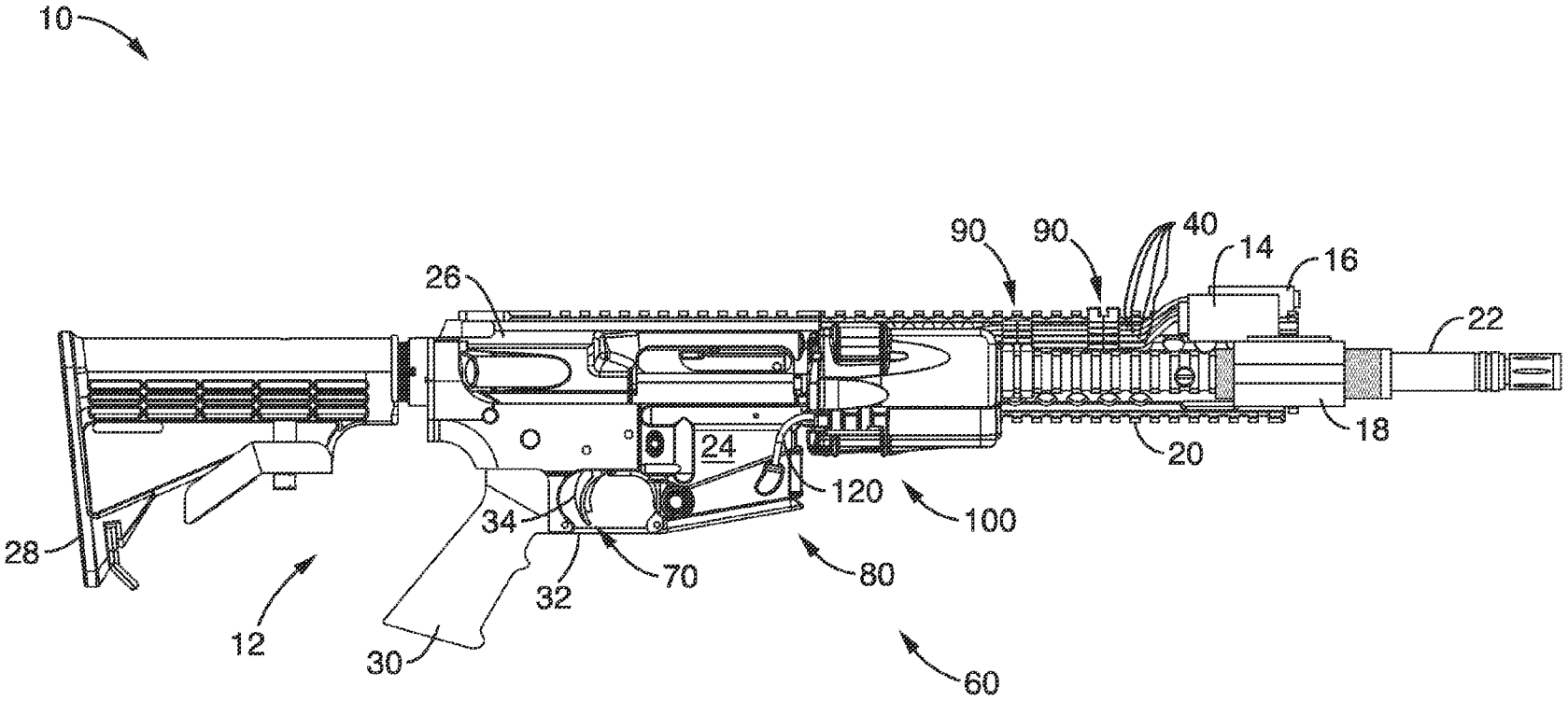
FIG. 1 is a side view of a firearm equipped with an accessory management system in accordance with the present invention.
Figure 2:
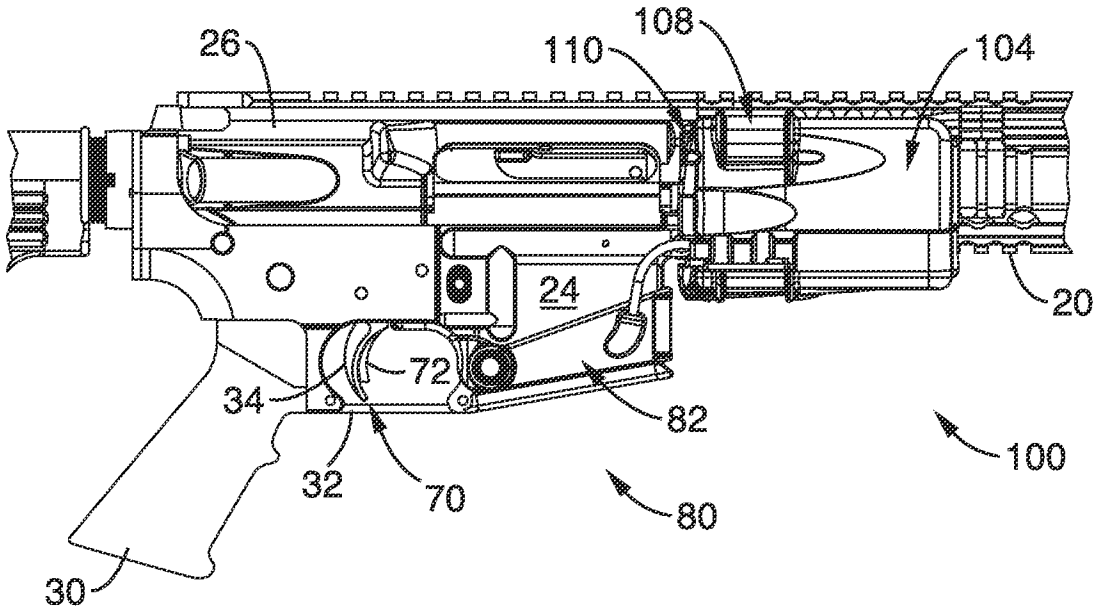
FIG. 2 is a close-up view of the accessory management system of FIG. 1.

FIG. 1 and FIG. 2 show side views of a firearm 10 equipped with a tactical rail accessory management system (TRAMS) 60 in accordance with the present invention. Tactical rail accessory management system 60 comprises an operation module comprising a mounted Tactical Rail Accessory Management Module (TRAMM) 100 configured for mounting to Picatinny rail 20 of rifle 12.

TRAMM 100 is configured for controlling activation of one or more auxiliary accessories (e.g. light 18, laser 14, IR illuminator 16) to be used in conjunction with rifle 12. Shepherd clips 90 may be used to harness and contain the multiple accessory cords 40 connecting the accessories 14, 16, 18 and the TRAMM 100. Rail crossing clips (not shown) may also be used to protect accessory cords that need to cross the Picatinny rails 20 from right to left, or from top to bottom.

In a preferred embodiment, TRAMS 60 includes a magazine-mounted remote activation module (MRAM) 80 configured to be secured around the magazine well 54 of the lower receiver 24 of rifle 10. MRAM 80 interfaces with TRAMM 100 via a control cord 120. It will be appreciated that a wireless interface (e.g. Bluetooth, etc. (not shown)) may also be used to interface between MRAM 80 and TRAMM 100).

It will be appreciated that remote activation, while preferred, is an optional feature of the present invention. For example, TRAMM 100 may comprise a stand-alone component with a device activation button positioned locally within its casing (not shown). In addition, while the remote activation module 80 is preferably positioned at the magazine well in close proximity to trigger 34 and trigger guard 32, it will be appreciated that remote activation may be achieved at other locations on the rifle 12 (e.g. stock 28, grip 30, upper receiver 26, etc.), or alternatively at a remote location from the user altogether (e.g. via a at or near a spotter via wireless communication means).

Referring to FIG. 2, a touch detection tab assembly 70 incorporating a modified trigger 34 incorporating a moveable metal blade (touch detection tab) 72 may also be included for activating an accessory device via the user's trigger finger.

FIG. 1 through FIG. 10 illustrate TRAMS 60 configured for use in conjunction with a firearm 12 comprising an AR-15, or M-16/M-4 class of weapons. However, it will be appreciated that the TRAMM 100, MRAM 80 and touch detection tab assembly 70 may be modified accordingly to fit and function with any number of different firearms. While the features and components of TRAMS 60 are shown configured as an add-on component for an existing firearm 10, it is also appreciated that they may be integrated into rifle 12 during manufacturing of the rifle.

Figure 3:
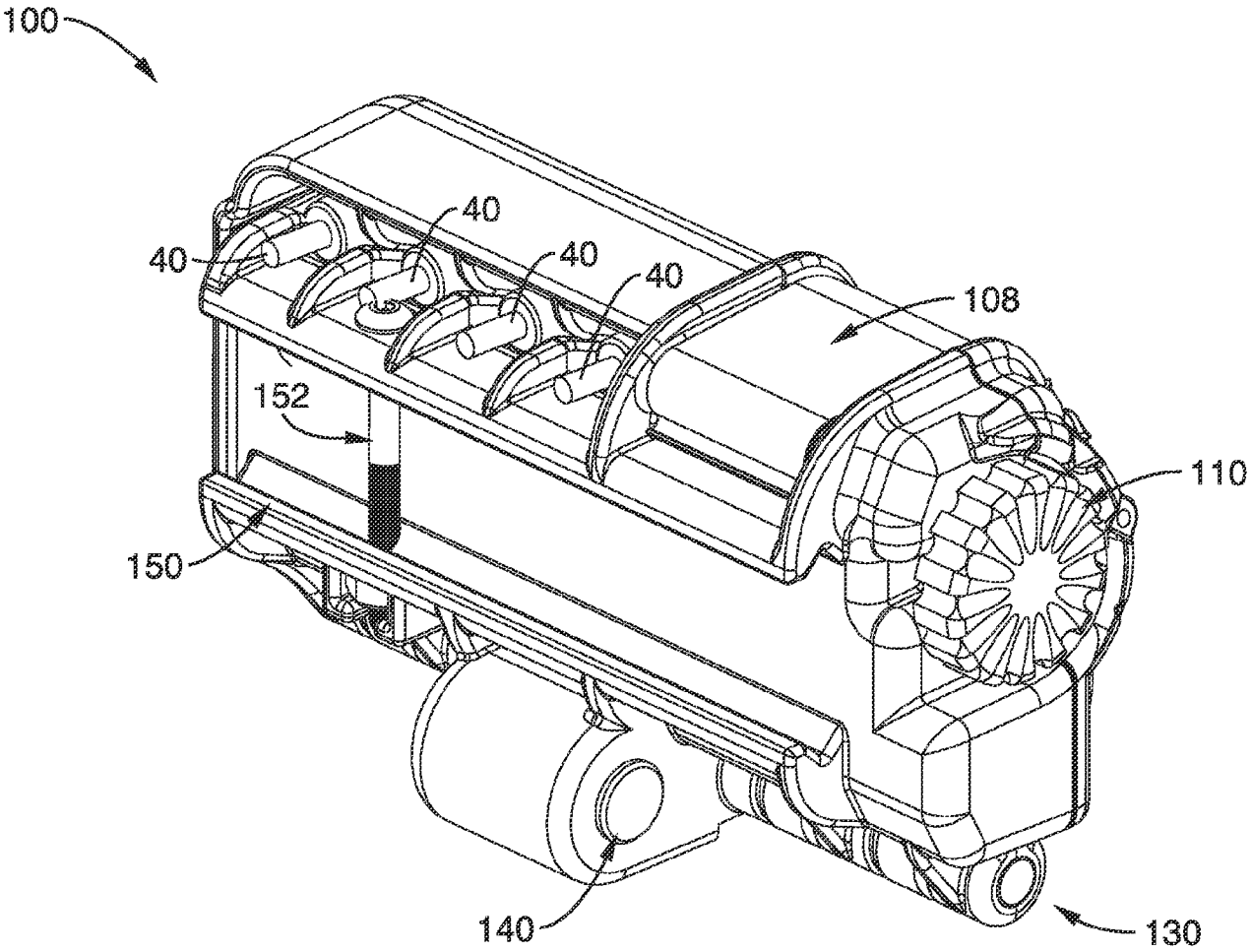
FIG. 3 is a perspective view of a tactical rail-mounted accessory management module in accordance with the present invention.
Figure 4:
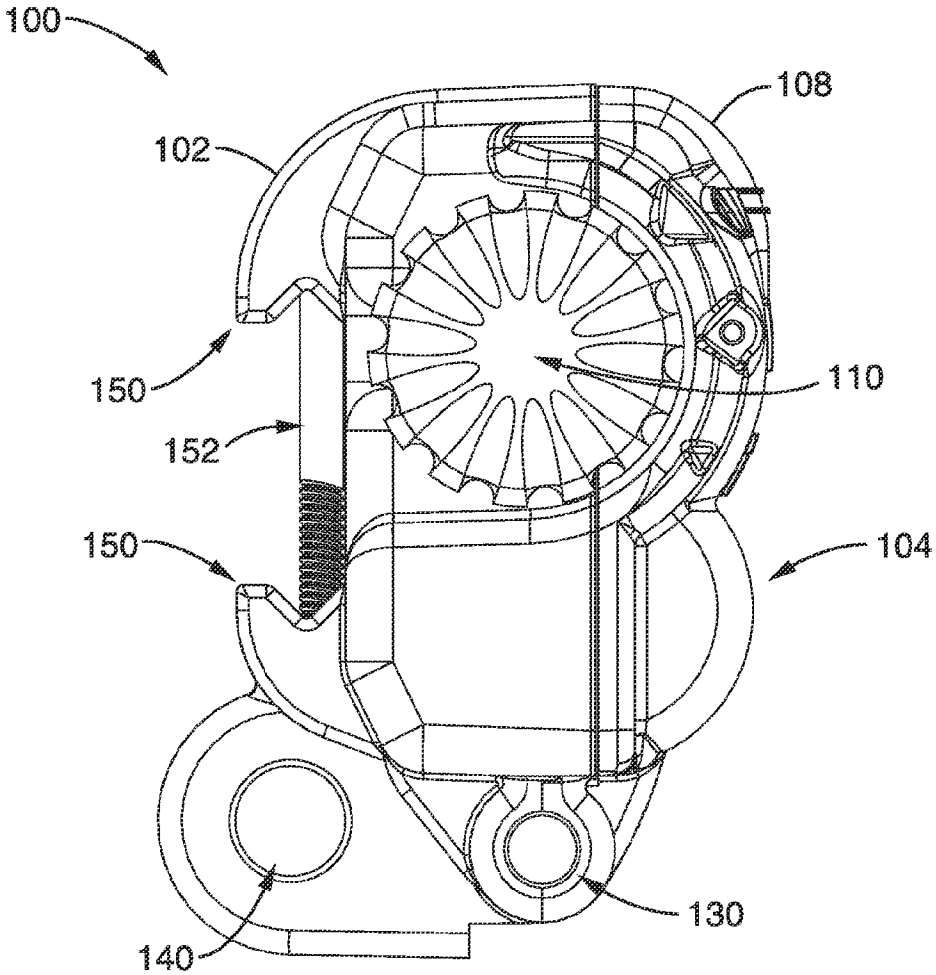
FIG. 4 is a frontal view of the tactical rail-mounted accessory management module of FIG. 3.

FIG. 3 and FIG. 4 show perspective and frontal views of the TRAMM 100 of the present invention. TRAMM 100, as shown in FIGS. 1 through 10, consolidates control of up to 4 accessories by allowing each auxiliary device (e.g. light 18, laser 14, IR illuminator 16, etc.) to plug directly into the rail mounted module TRAMM 100. The accessory devices may be preselected for single or grouped activation via micro toggle switches 114 (shown in greater) according to mission requirements prior to the mission.

TRAMM 100 includes a thumb-controlled rotary switch 110 to allow for rapid selection of covert (e.g. IR illuminator 16 or like devices), or overt (e.g. light 18 and/or laser pointer 14) on/off modes of operation with the shooting hand thumb or finger.

TRAMM 100 comprises a housing 105 having a grooved rail clamp 150 for fixedly fastening to rail 20 via a set screw 152. Housing 105 further includes a hinge 130 mounted lid 104 that is configured to be secured in a closed configuration with spring clip 109.

The TRAMM 100 comprises means for receiving cords 40 from the accessory devices, in addition to a control cord jack 140 for input from MRAM 80. While the embodiments illustrated in FIG. 1 through FIG. 10 show a TRAMM 100 configured for coupling up to 4 accessory devices, it will be appreciated that the unit may be configured for any number of devices.

Figure 5:
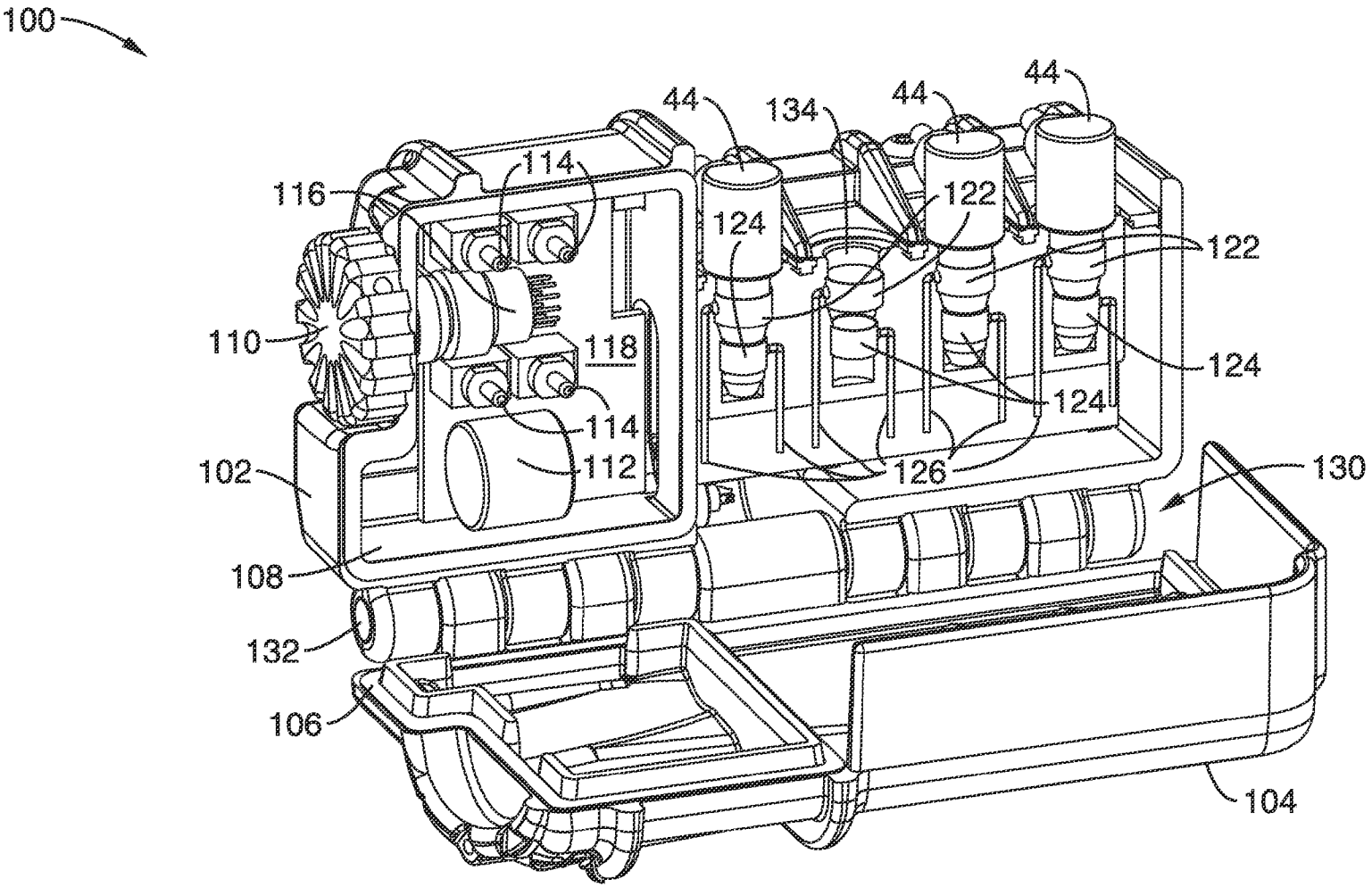
FIG. 5 is a perspective view of the tactical rail-mounted accessory management module of FIG. 3 with the lid open.

FIG. 5 illustrates TRAMM 100 with lid 104 rotated around hinge pin 132 so that the lid 104 rests in an open configuration to allow for access for internal components contained therein. Lid 104 optimally comprises gasket 106 to provide a waterproof enclosure for the toggle switch bay 108 when the lid 104 is closed.

Selection knob 110 passes through housing 102 to a rotary toggle switch 116 (which may comprise a Cole-B1150, or similar rotary switch available in the art) located within bay 108. The rotary toggle switch 116 is coupled to the plurality of accessory jacks 134 housed in bay 120 via leads 126. The electronic components are wired via a circuit board 118, which comprises a plurality of toggle switches 114 that act to switch control of various devices. Bay 108 is also configured to house battery 112 for powering the TRAMM 100.

Figure 6:
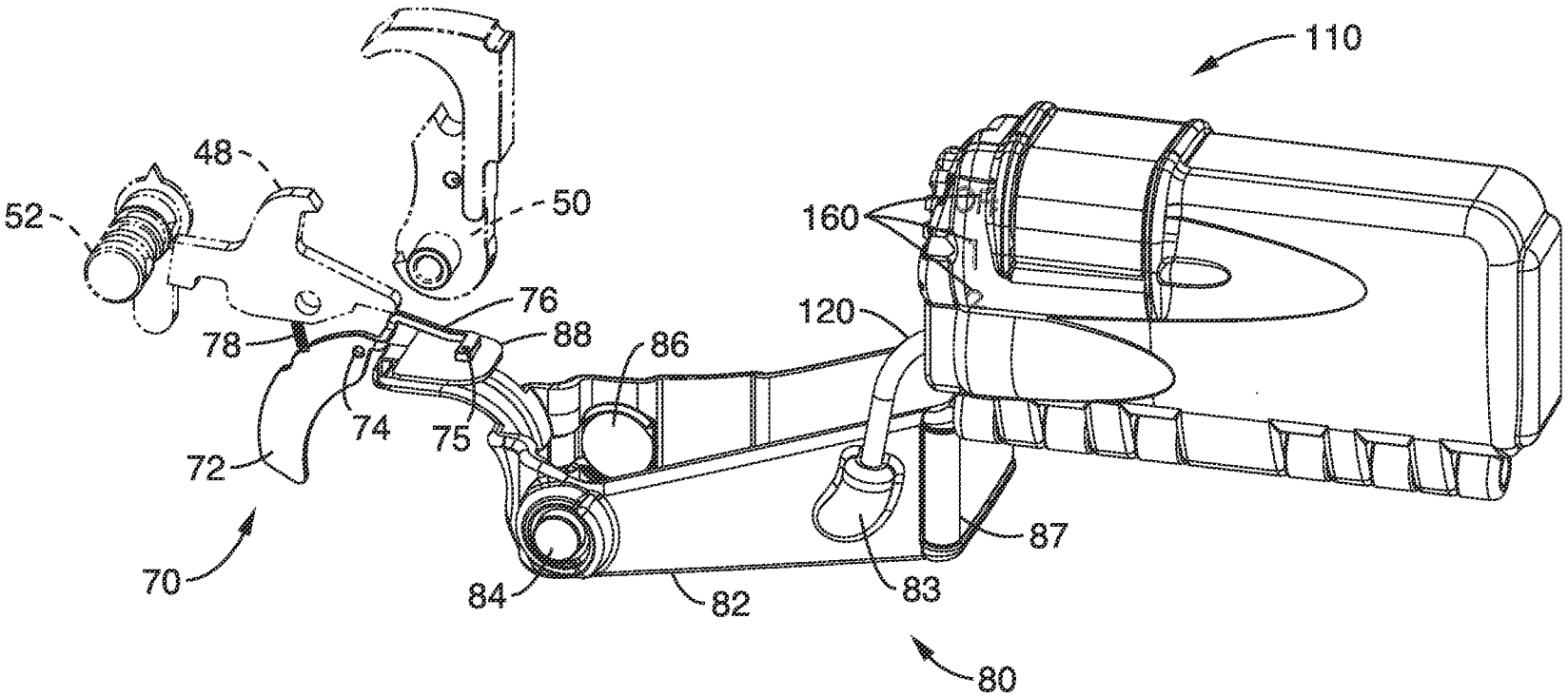
FIG. 6 is a perspective view of a magazine mounted remote activation module and touch detection tab with the tactical rail-mounted accessory management module and interfacing firearm components in accordance with the present invention.

In a preferred embodiment, rotary toggle switch 116 and selection knob 110 comprise three settings—Off, 1 (covert), and 2 (overt), which are delineated via markings 160 in FIG. 6. Thus, the plugs 44 that are coupled to the light 18 and laser 14 may be wired to be activated on with selection of the 2 (overt) setting, and the IR illuminator may be activated upon selection of the 1 (covert) setting. It will be appreciated, that any number of settings may be programmed (the Cole-B1150 rotary switch is capable of 9 settings). Respective toggle switches 114 (that are dedicated to each accessory device) may be switched "on" or "off" as desired by the user for selective activation (e.g. light 18 may be switched "off" so that the selection of the (overt) setting only activates laser 14, or vise versa).

Accessory jacks 134 are configured to receive accessory plugs 44 that are on the distal end of cords 40 for the respective accessory devices. Each jack comprises an upper contact 122 and a lower contact 124 that engage the respective plug 44 that is inserted into the jack receptacle 134. Plugs 44 preferably comprise identical mil spec end plugs available in the art.

Figure 7:
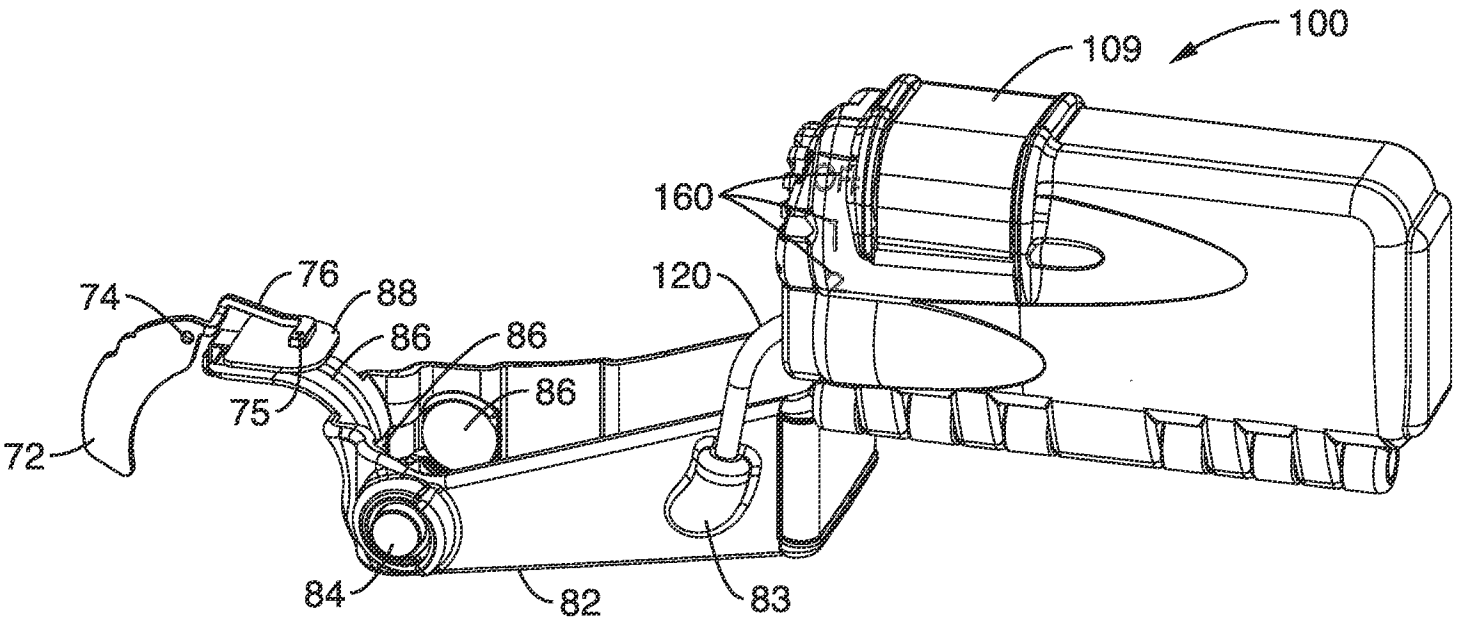
FIG. 7 is another perspective view of the components of FIG. 6.

FIG. 6 and FIG. 7 show perspective views of a MRAM 80 and touch detection tab assembly 70 with the TRAMM 100 module and interfacing firearm 12 components 80 and touch detection tab assembly 70 both comprise retractable elements (e.g. trigger-based touch detection tab 72 and MRAM buttons 84) that are independently capable of providing a control signal to the TRAMM100. The MRAM FIG. 9 is an exploded perspective view of the MRAM 80 along with the upper and lower receivers 26, 24 of an AR-15 rifle.

Figure 9:
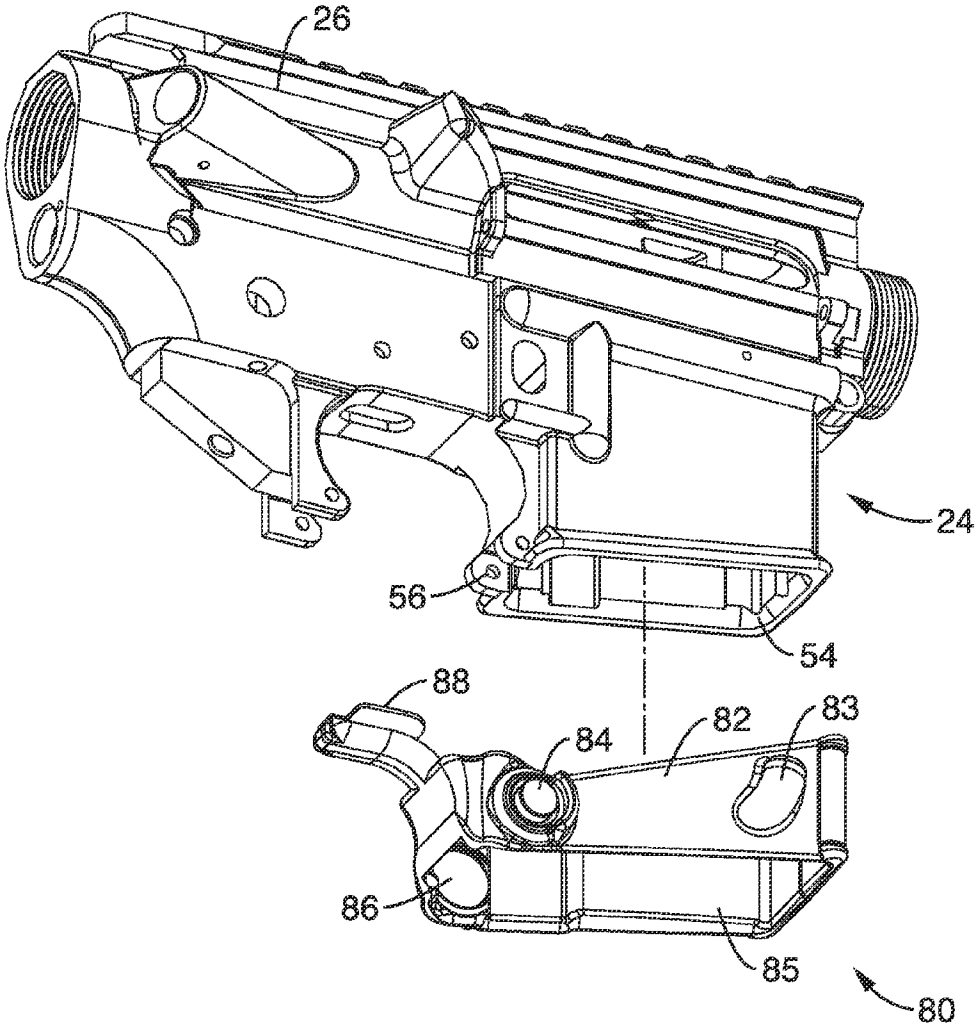
FIG. 9 is an exploded perspective view of the magazine mounted remote activation module along with the upper and lower receivers of an AR-15 rifle.

Referring to FIG. 9, MRAM 80 comprises a magazine housing 82 having opening 85 configured to be received over the magazine well 54 of the lower receiver 24, and locked into place via spring clip 87. The trigger guard 32 may be released from latch 56 for installation. The housing 82 retains two activation buttons 84 located on opposing sides of the housing 82 that coincide with flex circuit 86 on the inside of the housing 82.

The MRAM buttons 84 allow trigger finger accessory activation without needing to place the trigger finger inside the trigger guard 32. Upon depression of either button 84 (e.g. with trigger finger or thumb), the flex circuit is designed to convert motion if the button 84 into an electronic signal that is sent to the TRAMM 100 for activation of an accessory device. It is appreciated that the buttons 84 that activate the accessories may be positioned virtually on any part of the weapon 12, and do not necessarily need to be activated with the trigger finger.

The MRAM 80 and TRAMM 100 communicate via the control cord 120, which is connected to MRAM 80 at jack 83 and TRAMM 100 at jack 140. The control cord 120 carries the accessory activation signal caused by either the TDT 72 or the magazine buttons 84. In a preferred embodiment, the control cord 120 is armored with a stainless steel monocoil that is sheathed with a stainless steel braid (not shown) and covered with a high temperature resistant polyolefin coating (not shown). The control cord is highly flexible and does not need to be removed for weapon breakdown requirements. The control cord may comprise a mil spec plug, preferably with a soft connect (can be pulled out if the cord is snagged) and is preferably capable of omni-directional insertion.

Referring to FIG. 7, the surface mounted electronic component portion of the flex circuit 86 is configured to extend into the lower receiver 24 of the rifle 12 for use with the touch detection tab assembly 70. The flex circuit 86 comprises a carbon fiber backing plate that is used to compress the button 84 and flex circuit between the MRAM 82 and the backing plate. Cantilevered panel 88 includes a Hall Effect sensor to detect motion of the touch detection tab 72 via motion of extension arm 76 that rests over Hall Effect sensor panel 88 via magnetic gauss level fluctuations of magnet 75 disposed within arm 76 (switch closes with increasing gauss). Hall effect sensor panel 88 may, for example, comprise a sensor chip in accordance with sensor embodiments described in U.S. patent application Ser. No. 12/432,557 filed on Apr. 29, 2009, herein incorporated by reference in its entirety.

The touch detection tab 72 is pivotably coupled to trigger 34 via a hinge-pin (not shown) housed in hole 74 and 46 in trigger 34. Touch detection tab (TDT) 72 comprises a moveable metal blade that pivots about hole 74 to move flush to the trigger arm 36 with the first one ounce of trigger finger pressure, which results in respective motion of arm 76 downwards towards panel 88 for trigger-finger device activation. The TDT 72 moves arm 76 and magnet 75 towards the Hall Effect sensor circuit board 88, which is connected to flex circuit via circuit leads 86 extending from the MRAM housing 82. The Hall Effect circuit board 88 is securely held down against the floor of the lower receiver 24 with the existing trigger spring extensions (not shown) used for trigger 34. This positioning of board 88 is advantageous in that the component is held in place without any glue, or fixative by merely relying on the downward pressure of the existing trigger spring extensions.

The touch detection tab 72 acts against spring 78 that is butted against an installed pin (not shown) below disconnector 48, which returns the tab 72 to an extended configuration upon release by the user. Safety 52 and hammer 50 are also coupled to the trigger 72 as generally understood in the art.

Figure 8:
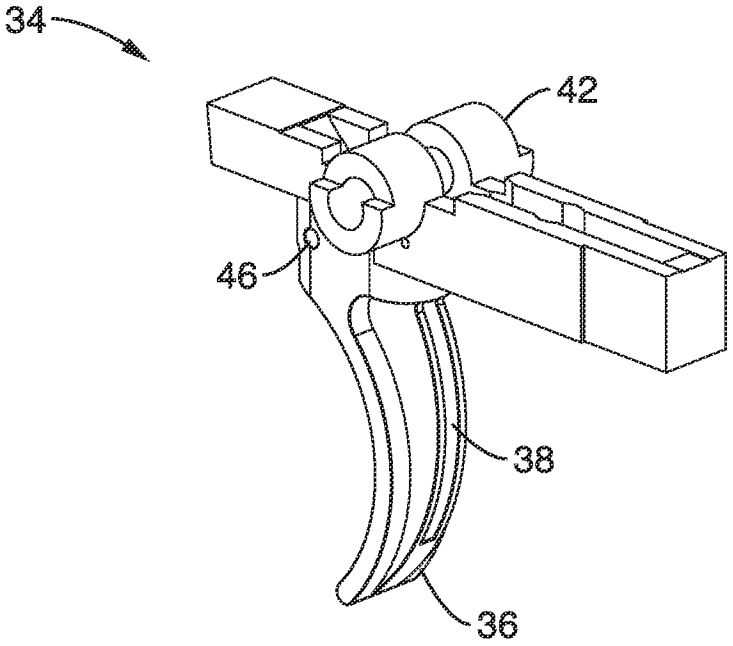
FIG. 8 is a perspective view of a trigger modified for use with the touch detection tab of FIG. 6 and FIG. 7.

FIG. 8 is a perspective view of a trigger 34 modified for use with the touch detection tab 72 of FIGS. 6 and 7. Trigger 34 comprises arm portion 36 that has a slot 38 for receiving TDT 72. While TDT 72 rotates about hole 46, the trigger arm 36 rotates about hinge 42.

The TDT 72 allows trigger finger touch activation of the accessories by mounting a movable device onto the trigger 34. A shooter's trigger finger can then activate a laser 14 or other accessory instantly prior to shooting his weapon for the most rapid accessory targeting response to a deadly situation.

It is appreciated that the touch detection system 70 of the present invention is optional. In such case, flex circuit 86 would not comprise the panel 88, and activation would solely be achieved via buttons 84 and corresponding sections of flex circuit 86.

Some organizations are hesitant to allow the shooter's trigger finger to be inside the trigger guard for any reason other than shooting the weapon. Accessory activation precedes the discharge of the weapon, but the shooter may change his/her mind after accessory activation and not discharge the weapon. The trigger finger may then remain on the trigger for accessory activation, even when the shooter has changed his/her mind about discharging the weapon.

Accordingly, the MRAM buttons 84 may be of a momentary ON type, typically used with the trigger activation TDT system 70, or they may be of a Push On, Push Off type if the TDT system 70 is deleted from the TRAMS 60. These configurations are shown in further detail with respect to schematic drawings 12-17B. The non-TDT embodiment requires the shooter to activate the accessories via the button 84 prior to placing his/her finger inside the trigger guard 32, which satisfies some organizations requirements for perceived trigger training protocols.

Figure 10B:
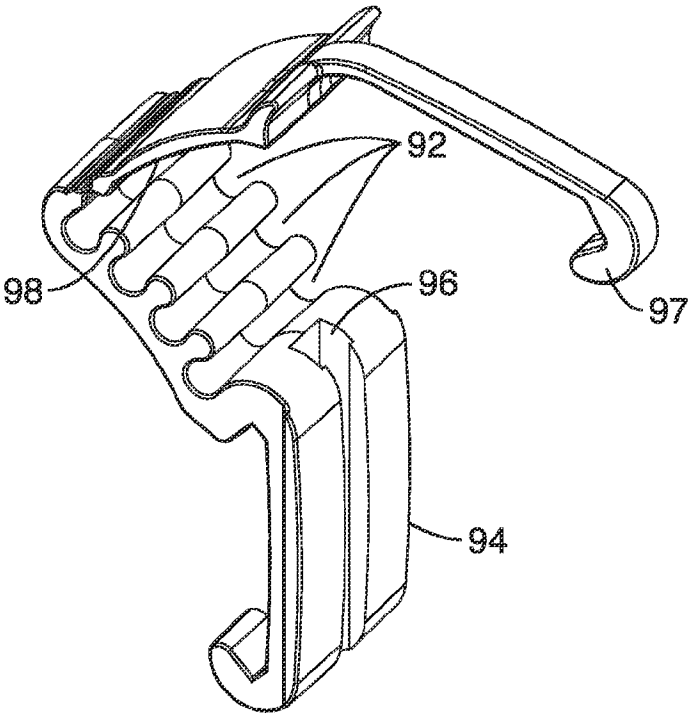
FIG. 10B is a perspective view of an alternative accessory cord retaining clip in accordance with the present invention.
Figure 10A:
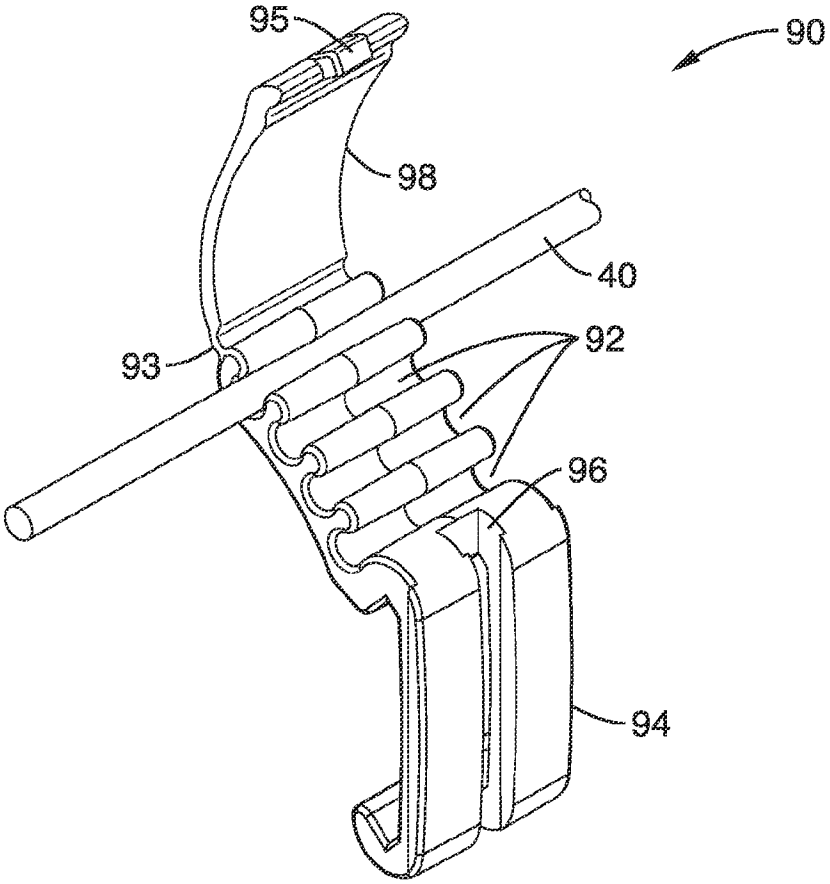
FIG. 10A is a perspective view of an accessory cord retaining clip in accordance with the present invention.

FIG. 10A shows a perspective view of shepard clip or clasp 90 for retention and control the multiple cords 40, keeping cords 40 hidden and away from snag threats. Clip 90 comprises a clamping portion 94 for retaining the clip on the rail 20 of the rifle 12. A plurality of parallel grooved slots 92 are included in a retaining section for retaining the individual cords 40. The clip also comprises a cap 98 that folds over reduced section 93 with tab 95 that snaps into groove 96 to further retain the cords 40.

FIG. 10B shows a perspective view of an alternative shepard clip 91 for retention and control the multiple cords 40. Clip 91 comprises a clamping portion 94 for retaining the clip on the rail 20 of the rifle 12. A plurality of parallel grooved slots 92 are included for retaining the individual cords 40. The clip also comprises a cap 98 that folds over reduced section 93 with extended tab 97 that snaps into groove 96 to further retain the cords 40.

Rail crossing clips (not shown) may also be employed to keep the accessory cords from being damaged in the event of a rail impact. The rail crossing clips attach to the top and side rails 20 and allow impact protection of the accessory cords 40 which need to pass across the top rail from right side to left side.

Multiple shepherd clips 90 may be used to attach to the rails 20, and allow cord 40 control by firmly holding the cords 40 securely against the weapon in the recessed areas between the rails 20.

Referring now to FIG. 11 through FIG. 18B, the invention employs circuitry that can be implemented in various embodiments. The embodiments shown are by way of example, and those skilled in the art will appreciate that the circuitry could be implemented in other embodiments to perform the same or similar functions described herein.

Figure 11:
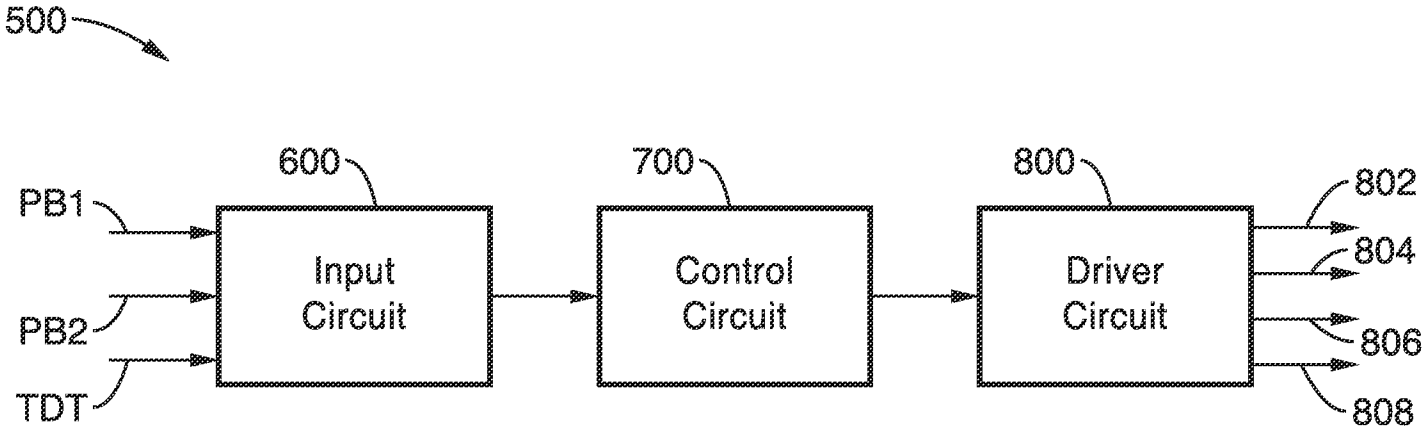
FIG. 11 is a functional block diagram illustrating an embodiment of an electrical interface of the invention.

FIG. 11 illustrates a functional block diagram of an embodiment 500 of the electrical interface employed in the invention. As previously described, the activation interface between the MRAM 80 and TRAMM 100 preferably comprises a pair of pushbutton switches on the MRAM, and an optional TDT mechanism for activation, although activation could be by alternative means, such as by a wired switch that is remotely located from the firearm, or by a wireless receiver and switch that are activated by a remotely located transmitter. Associated input circuitry is also provided, which is depicted in FIG. 11 as input circuit 600.

In FIG. 11, the labels PB1 and PB2 denote the pushbutton switches on the MRAM, and the label TDT denotes the TDT mechanism. Input circuit 600 is electrically connected to control circuit 700, and control circuit 700 is electrically connected to driver circuit 800. Driver circuit 800 has a plurality of outputs for activation of accessory devices, and four such outputs labeled as 802, 804, 806 and 808 are shown by way of example. Additional outputs could be provided if desired.

Figure 12:
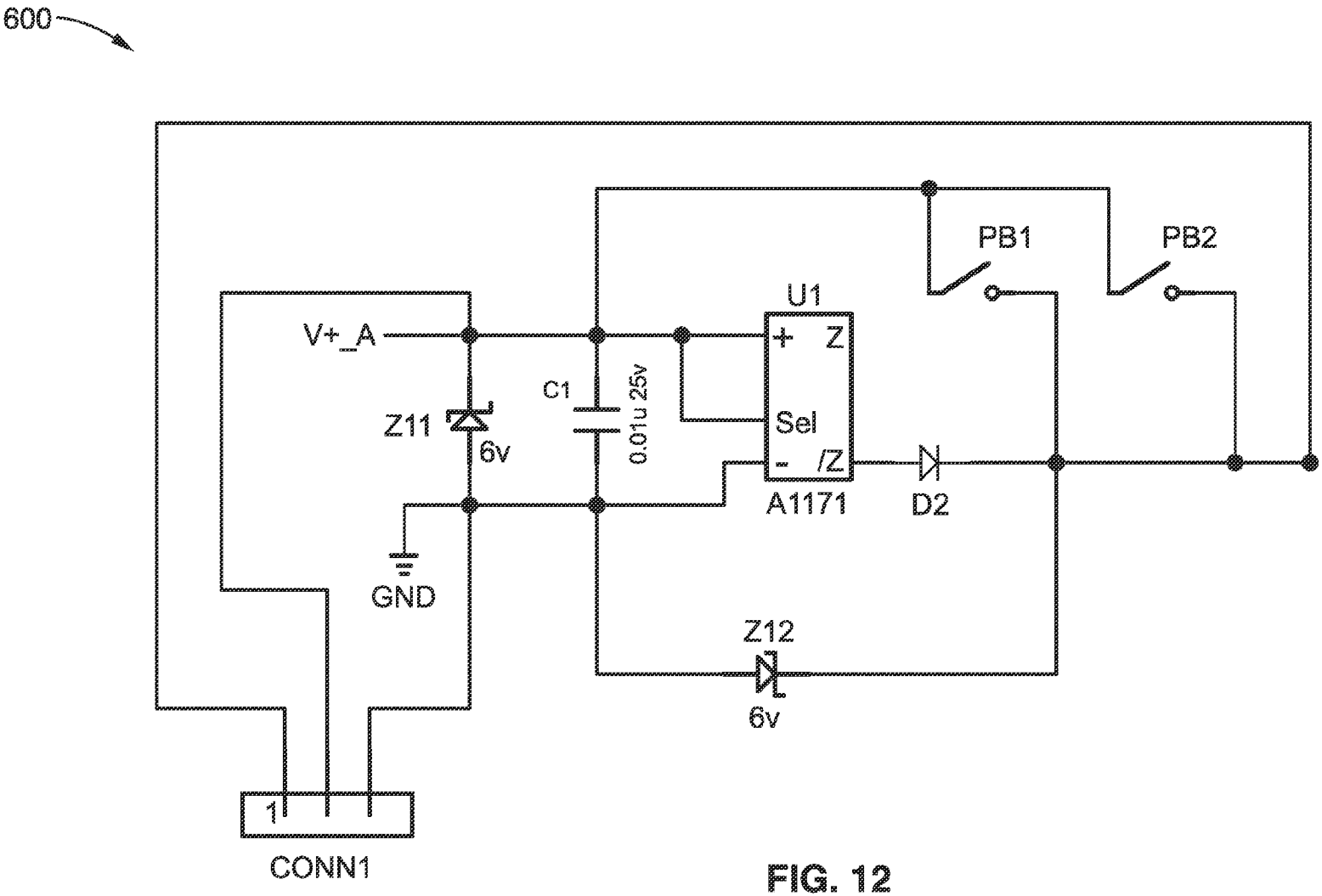
FIG. 12 is a schematic diagram of an embodiment of an input circuit of the invention.
Figure 13A:
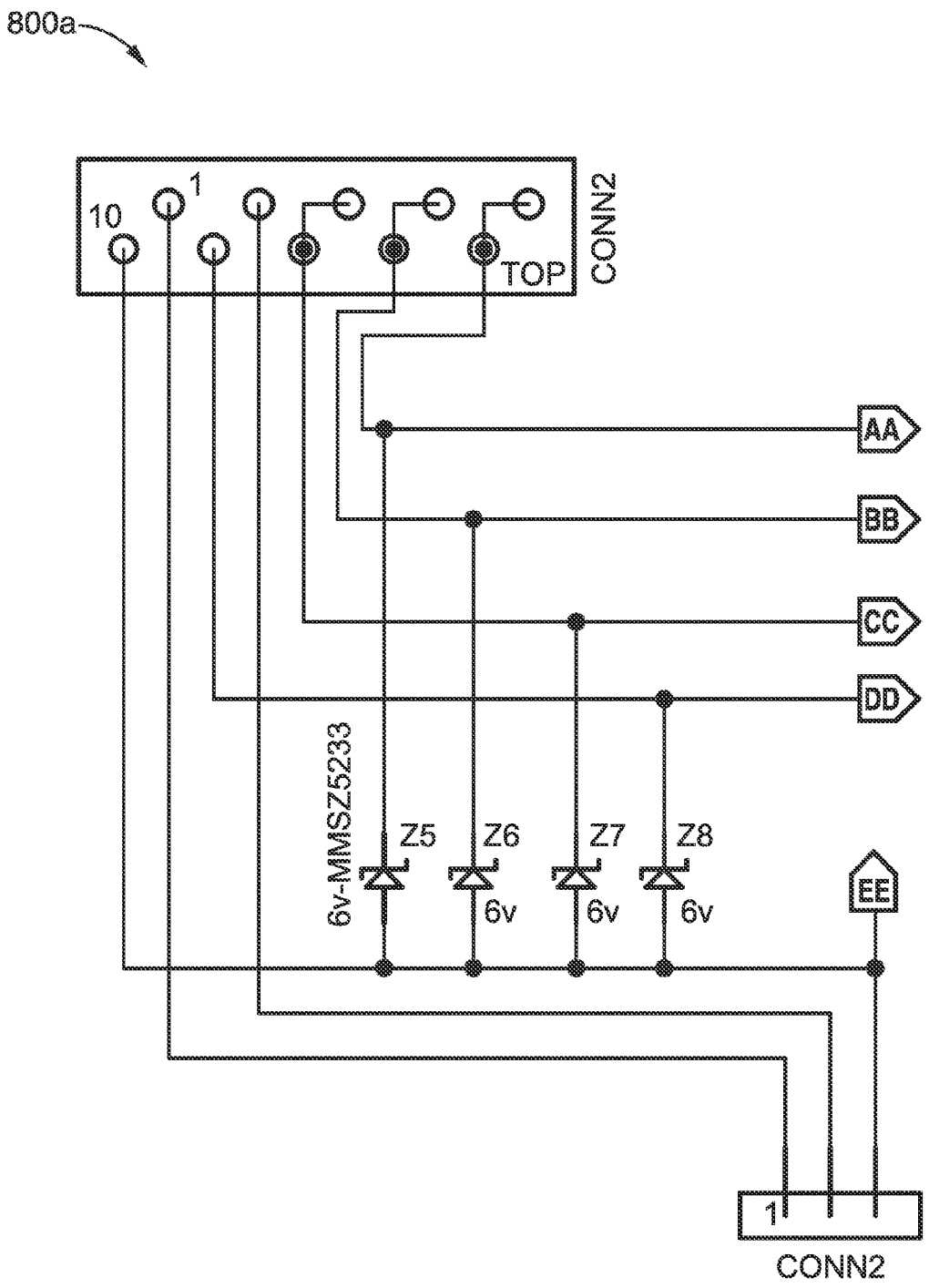
FIG. 13A and FIG. 13B are a schematic diagram of an embodiment of a driver circuit of the invention.
Figure 13B:
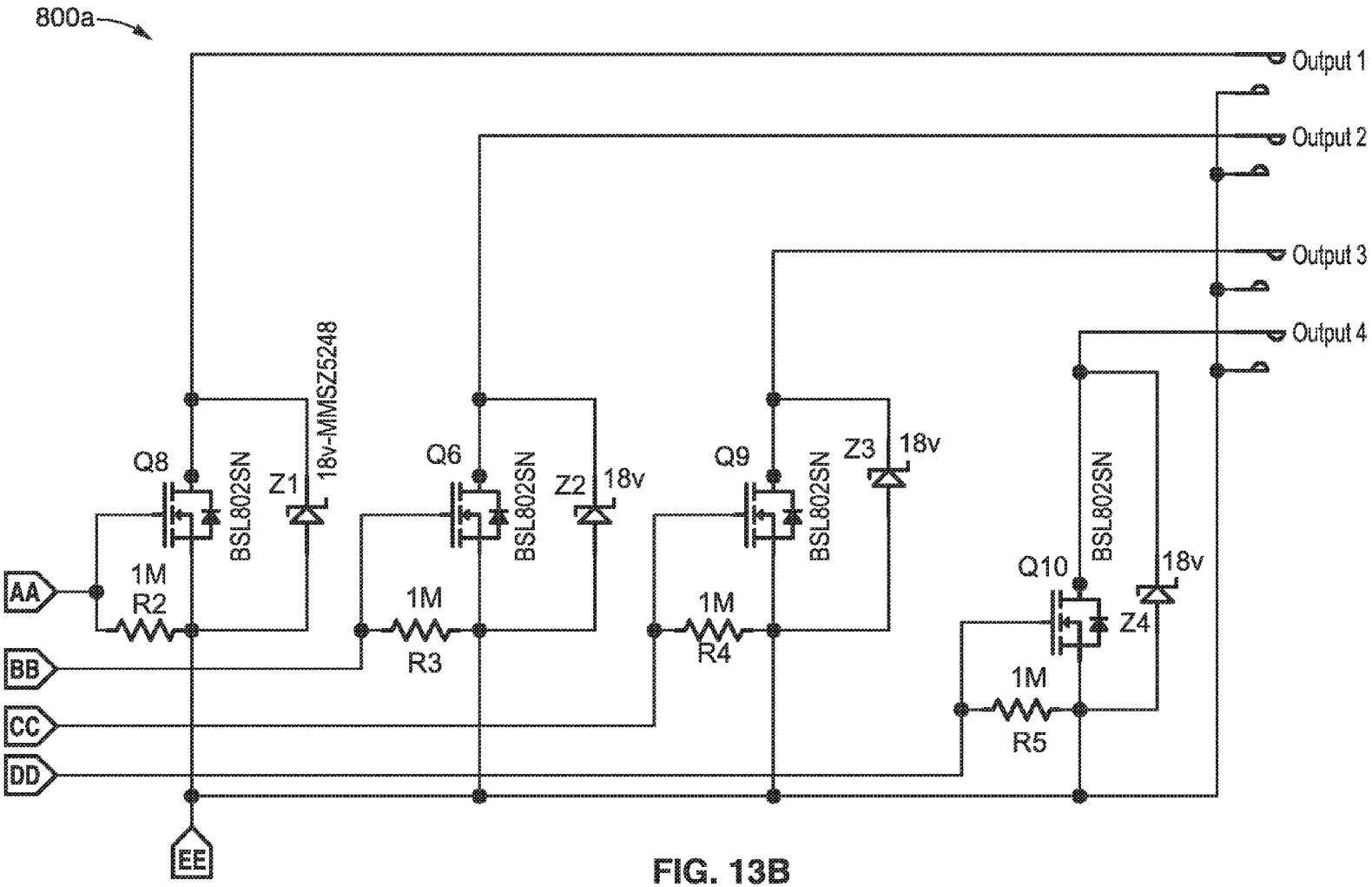
Figure 14:
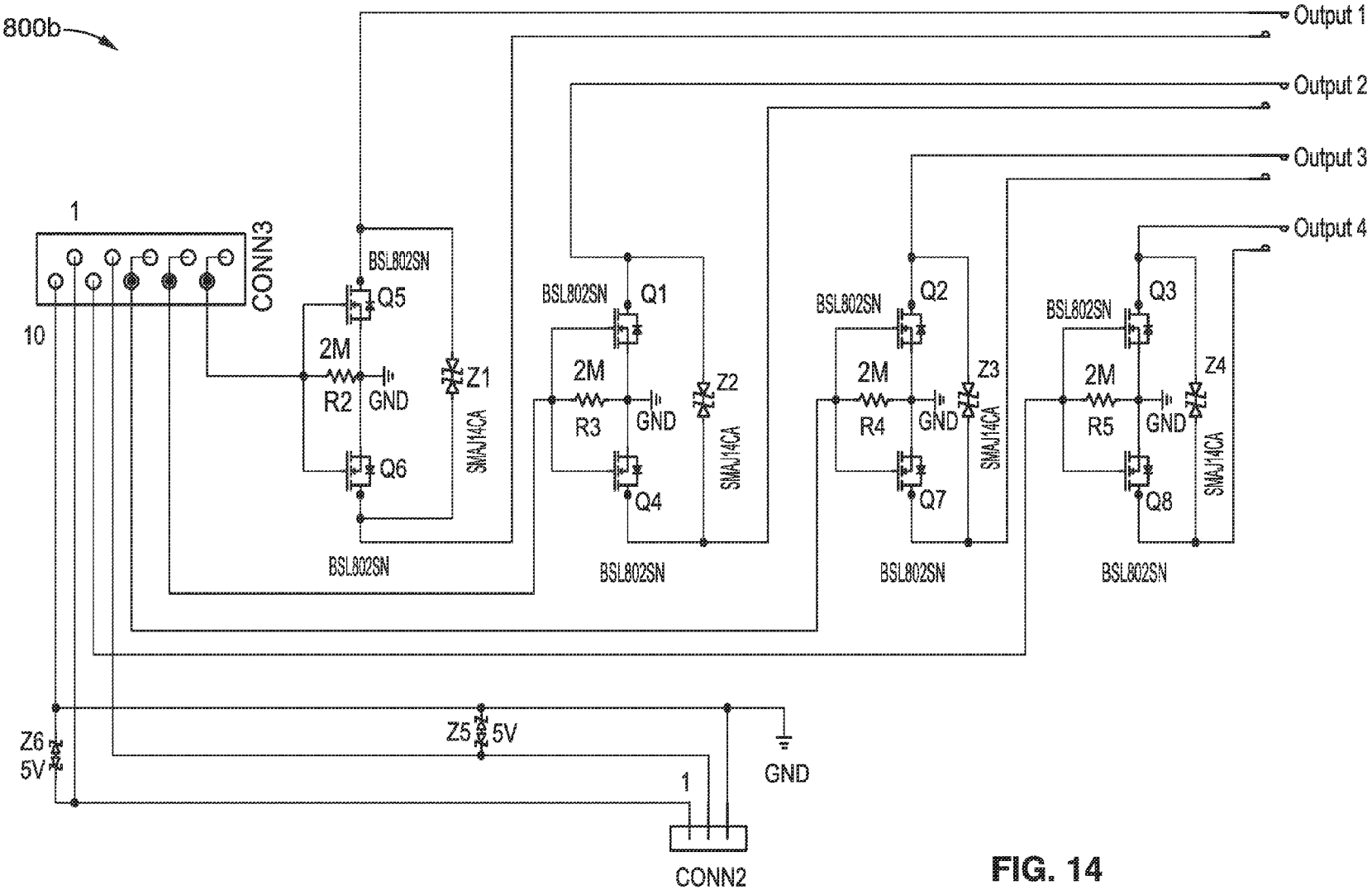
FIG. 14 is a schematic diagram of an alternative embodiment of a driver circuit of the invention.
Figure 15:
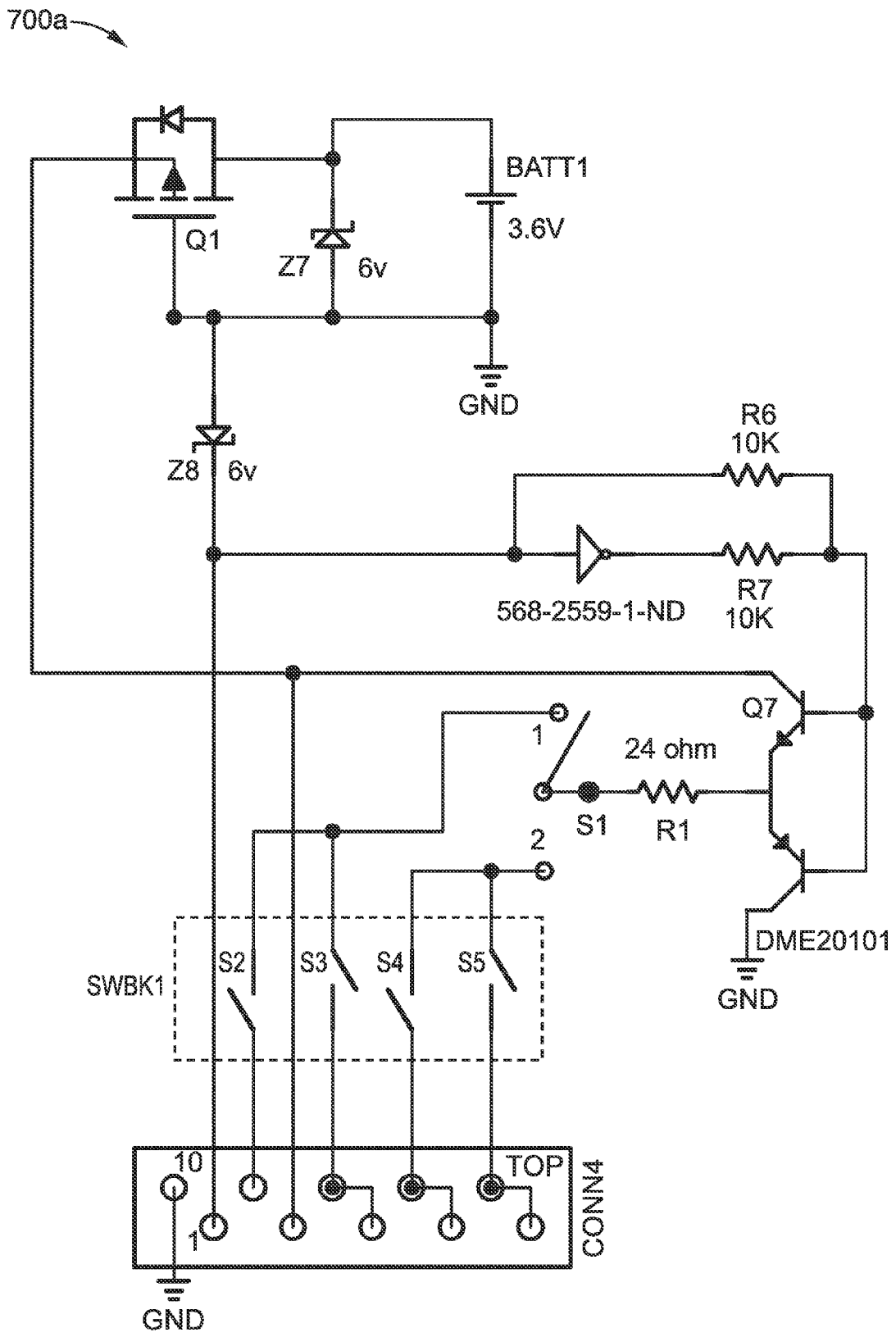
FIG. 15 is a schematic diagram of an embodiment of a control circuit of the invention.
Figure 16:
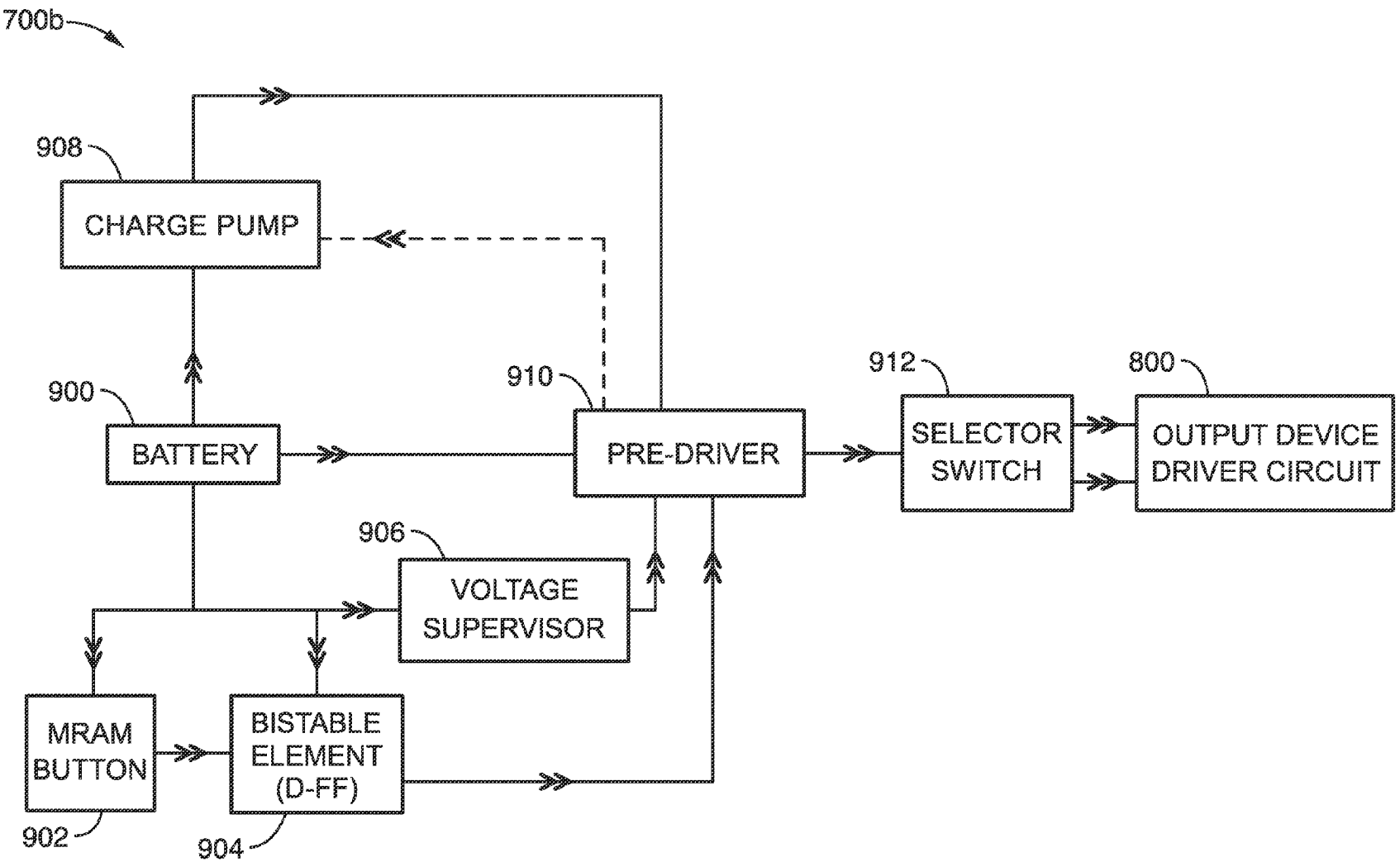
FIG. 16 is a functional block diagram illustrating an alternative embodiment of a control circuit of the invention.
Figure 17A:
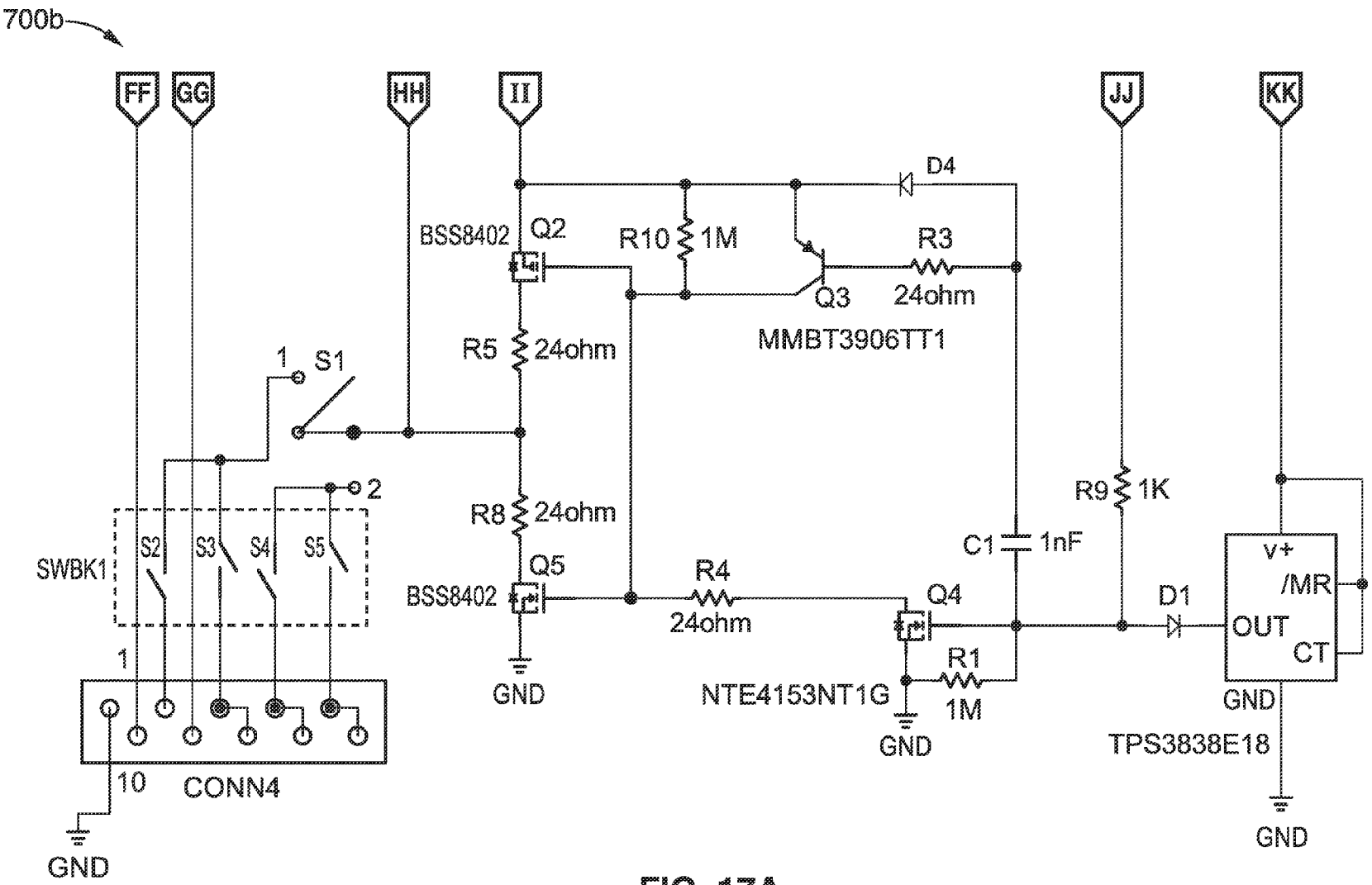
FIG. 17A and FIG. 17B are a schematic diagram corresponding to the block diagram of FIG. 16.
Figure 17B:
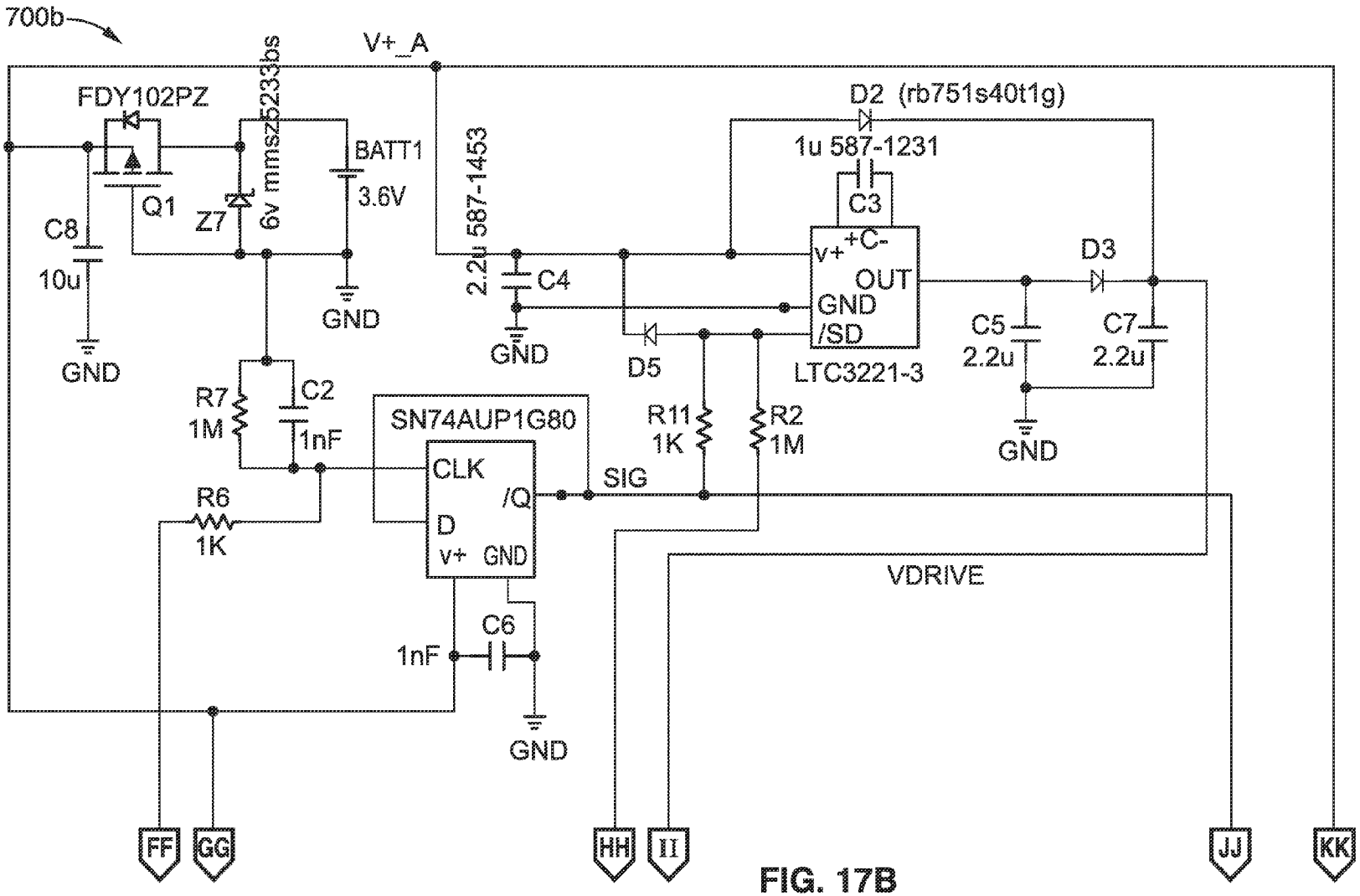
Figure 18A:
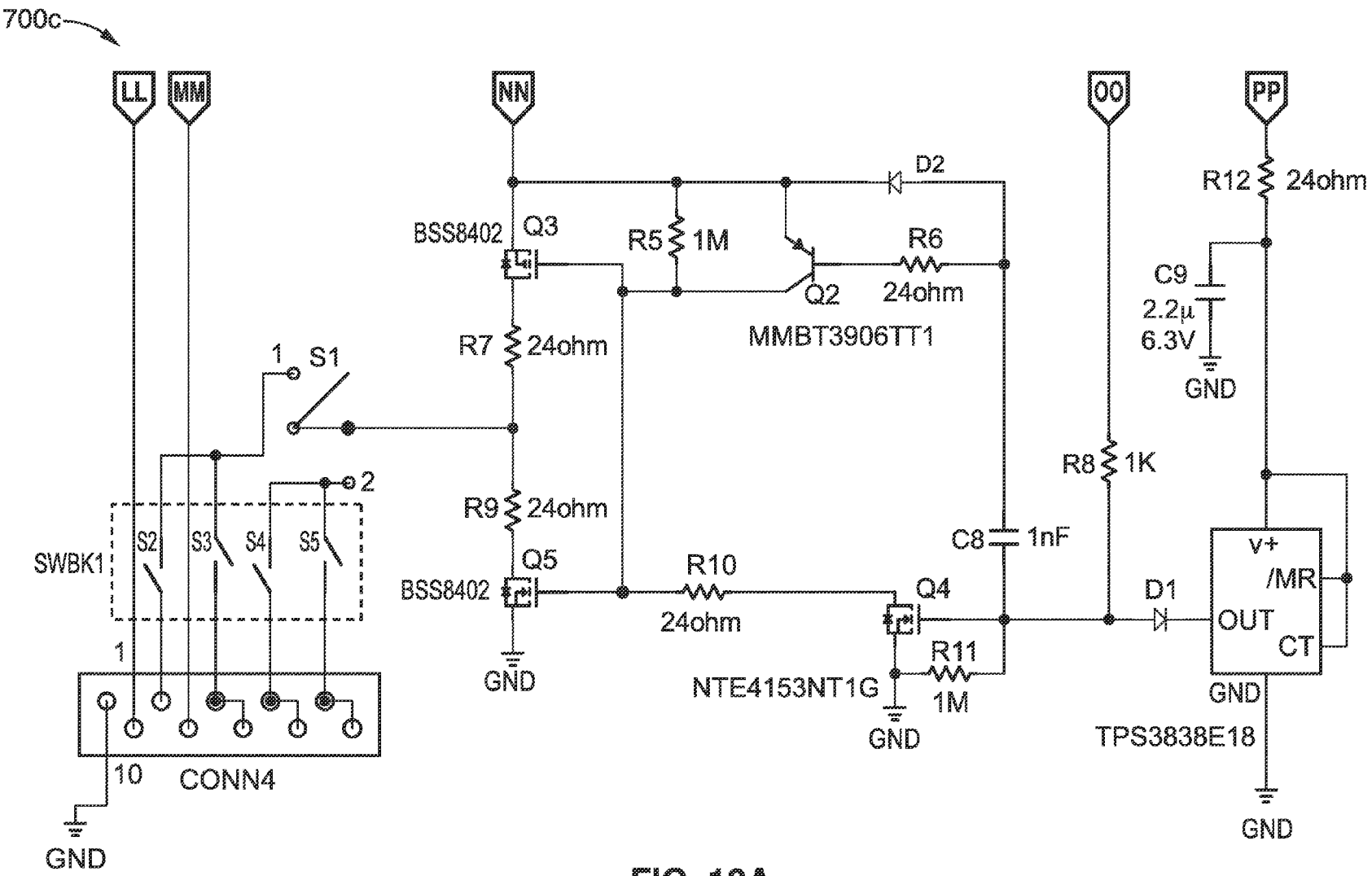
FIG. 18A and FIG. 18B are a schematic diagram of an alternative embodiment of the control circuit shown in FIG. 17A and FIG. 17B.
Figure 18B:
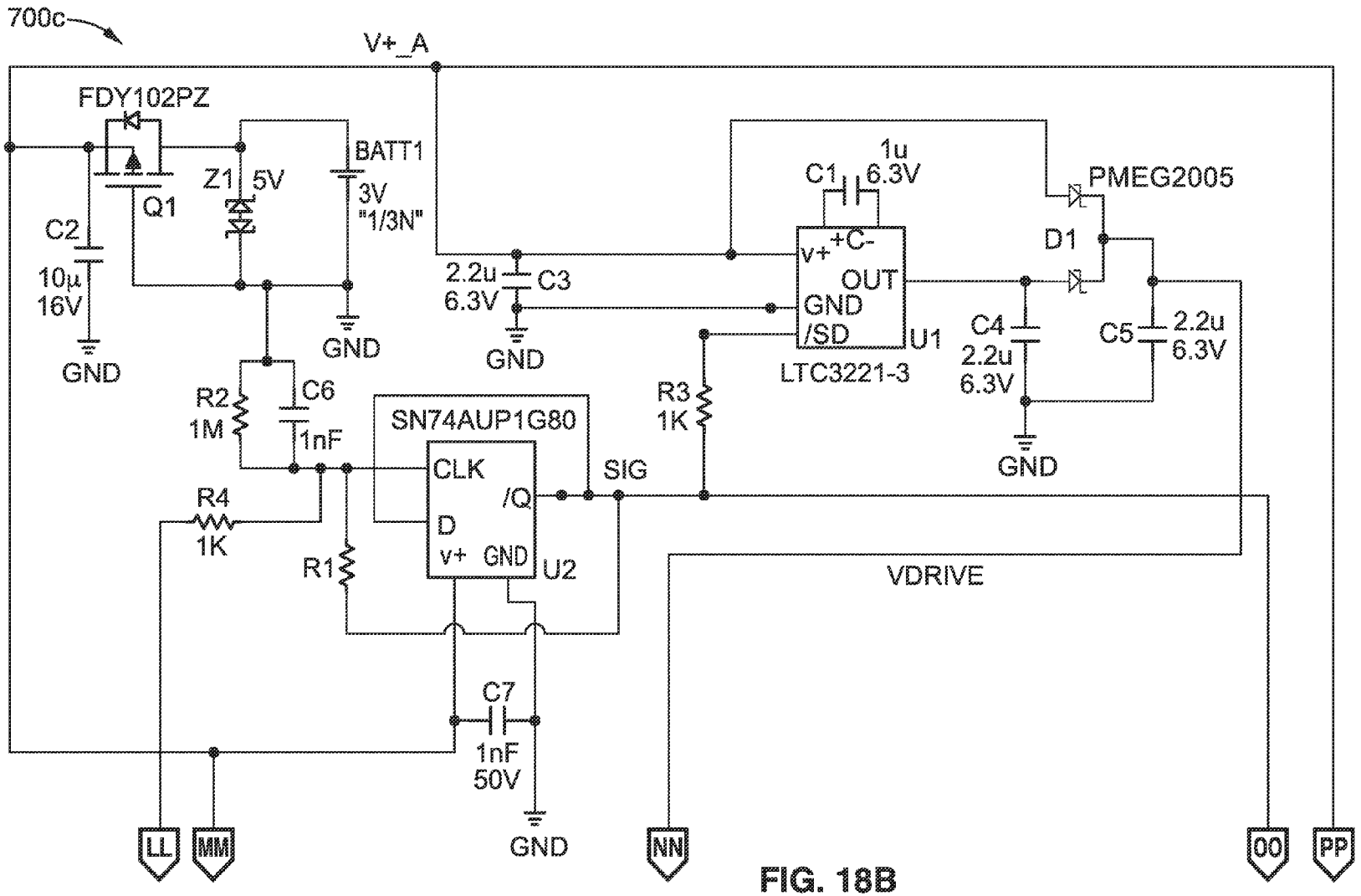

FIG. 12 illustrates an example of circuitry for implementing input circuit 600. FIG. 13A and FIG. 13B illustrate an example of circuitry for implementing an embodiment 800*a* of driver circuit 800. FIG. 14 illustrates an example of circuitry for implementing an alternative embodiment 800*b* of driver circuit 800. FIG. 15 illustrates an example of circuitry for implementing an embodiment 700*a* of control circuit 700 where two pushbutton switches and a TDT are used activation of accessories. FIG. 16 illustrates a functional block diagram and FIG. 17A and FIG. 17B illustrate corresponding circuitry for implementing an alternative embodiment 700*b* of control circuit 700 were only pushbutton switches are used for activation of accessories. FIG. 18A and FIG. 18B illustrate an alternative embodiment of the circuitry shown in FIG. 17A and FIG. 17A that can provide either momentary pushbutton activation functionality or push-on, push-off, latching type pushbutton activation functionality.

Referring more specifically to FIG. 12, the preferred embodiment of the input circuit 600 illustrated employs two pushbutton switches for activation of accessories, denoted in the schematic as PB1 and PB2. The input circuit also optionally includes a type A1171 micropower ultrasensitive hall effect switch, denoted as U1, for activation based on sensing proximity of the magnet carried by the TDT mechanism. The connector labeled CONN1 mates with the connector labeled CONN2 in the embodiment 800*a* of driver circuit 800 shown in FIG. 13A and FIG. 13B, or with the connector labeled CONN2 in the embodiment 800*b* of driver circuit 800 shown in FIG. 14.

Referring again to FIG. 11, the function of driver circuit 800 is to provide isolated electronic switching at outputs 802, 804, 806 and 808 for activating and deactivating accessories of different types. Preferably such switching is implemented using a bank of switching transistors such as those illustrated in the embodiment shown in FIG. 13A and FIG. 13B, and also in the embodiment shown in FIG. 14.

Referring more specifically to FIG. 13A and FIG. 13B, a plurality of BLS802SN small signal MOSFETs are used in embodiment 800*a* of driver circuit 800, one for each of outputs 802, 804, 806 and 808, in the example configuration shown. Other devices could be used as well. The connector labeled CONN2 mates with the connector labeled CONN1 in the input circuit shown in FIG. 12. The connector labeled CONN3 mates with the connector labeled CONN4 in the embodiment of the control circuit 700*a* shown in FIG. 15, or mates with the connector labeled CONN4 in the embodiment of the control circuit 700*b* shown in FIG. 17A and FIG. 17B. Additionally, zener diodes Z5 through Z8 shown in the circuit are optional.

In FIG. 14, an alternative embodiment 800*b* of driver circuit 800 is shown. In this embodiment, two back-to-back MOSFETs are used for each of outputs 802, 804, 806 and 808 in a configuration that is not polarity dependent in relation to the accessory being switched. For example, one manufacturer might provide switch connections on the accessory with a positive center wire whereas another might provide a negative center wire. While polarity may not be relevant for a mechanical switch, it can be relevant for an electronic switch. Therefore, the embodiment of FIG. 14 has the advantage of not requiring polarity to be taken into account when connecting the accessory switch leads to any of the outputs of the driver circuit. Note also that in the embodiment of FIG. 14, the device ground connections are associated with the circuit itself so that the ground path is not through any of the other interconnected circuits.

The connector labeled CONN2 mates with the connector labeled CONN1 in the input circuit shown in FIG. 12. The connector labeled CONN3 mates with the connector labeled CONN4 in the embodiment of the control circuit 700*a* shown in FIG. 15, or mates with the connector labeled CONN4 in the embodiment of the control circuit 700*b* shown in FIG. 17A and FIG. 17B.

Referring now to FIG. 15, an embodiment 700*a* of control circuit 700 is shown for use when accessories will be activated by either the TDT mechanism or by the pushbutton switches. In this embodiment, an accessory is activated only during the time that the user depresses a pushbutton switch or uses the TDT mechanism. In other words, the embodiment shown in FIG. 15 is for momentary activation of an accessory. Since trigger action supersedes button pushing in a live-fire scenario, it is preferably to use momentary pushbutton activation rather than latching-type pushbutton activation. This is in contrast to the embodiment shown in FIG. 16, FIG. 17A, and FIG. 17B where the control circuit provides the pushbutton switches with push-on, push-off functionality.

Also shown in FIG. 15 is a three-position switch 51 which is the previously-described rotary switch. In the embodiment illustrated in FIG. 15, the switch has three positions: Off, Channel A, and Channel B for selection of "channels" or "banks" of accessories. Also in the embodiment shown, each channel can have up to two accessories activated at the same time, depending on how the output line enable switches S2, S3, S4, and S5 in switch bank SWBK1 are set. These are the previously-described toggle switches, and these switches enable or disable operation of an output in. It will be appreciated, however, that additional channels or banks could be provided, thereby expanding the number of positions in the channel selector switch, the number of output line enable switches, and or the number of accessories controlled in a channel or bank.

The connector labeled CONN4 mates with the connector labeled CONN3 in the embodiment of the driver circuit

800*a* shown in FIG. 13A and FIG. 13B, or mates with the connector labeled CONN3 in the embodiment of the driver circuit 800*b* shown in FIG. 14.

Referring now to FIG. 16, FIG. 17A and FIG. 17B, an embodiment 700*b* of control circuit 700 is illustrated. In this embodiment, which is not intended for use with a TDT mechanism, the pushbuttons provide a latching-type function. In other words, this embodiment provides for push-on, push-off, activation of accessories.

Referring more specifically to the functional block diagram of FIG. 16, the battery 900 provides power to the MRAM pushbutton switch 902, bistable element 904, voltage supervisor 906, charge pump 908, and pre-driver circuit 910. Momentarily pressing the pushbutton switch causes the bistable element to change state. The state of the bistable element is mirrored by the pre-driver circuit, the output of which is fed through the selector switch 912 (combination of rotary and toggle switches), and causes an accessory to be activated through the driver circuit 800. Momentarily pressing the pushbutton again causes the bistable element to change state, thereby deactivating the accessory. Accordingly, the circuit provides for electronic latching instead of requiring a mechanically latching pushbutton switch, and an accessory can be toggled on and off by sequentially pressing the pushbutton switch.

The voltage supervisor monitors battery voltage and inhibits turn-on of the pre-driver stage if the battery voltage falls below a predetermined threshold for low battery protection. As additional low battery protection, the charge pump increases battery voltage to a value adequate to drive the output devices, thereby compensating for voltage drop due to temperature/battery charge stage.

For example, a low battery state could result in a failure of the MOSFETs to limit the current flow in an accessory that has a "dumb" power circuit or uses a simple power over contacts circuit. The power consumption of some accessories could potentially exceed five amperes and causes burnout of the driver circuitry if the battery was too low to control the circuit.

Optionally, feedback to the charge pump could be provided from the pre-driver stage to disable the charge pump, thereby reducing current consumption when a device is in the "off" state to improve battery life.

FIG. 17A and FIG. 17B schematically illustrate circuitry for the embodiment 700*b* of the control circuit 700. As with the previously-described embodiment 700*a* of control circuit 700, the connector labeled CONN4 mates with the connector labeled CONN3 in the embodiment of the driver circuit 800*a* shown in FIG. 13A and FIG. 13B, or mates with the connector labeled CONN3 in the embodiment of the driver circuit 800*b* shown in FIG. 14.

Referring to FIG. 18A and FIG. 18B, an embodiment 700*c* of control circuit 700 is illustrated. In this embodiment, the circuitry can be configured to provide either the momentary activation functionality provided by the circuitry shown in FIG. 15 or the push-on, push-off functionality provided by the circuitry shown in FIG. 17A and FIG. 17B. The momentary activation functionality can be accomplished in this circuit by simply placing a zero-ohm resistor, denoted at R1, between the output of bistable element U2 and the clock input, thus bypassing the bistable element.

The TRAMS 60 components may be fabricated with various production technologies ranging from injection molding of fiber reinforced modules, to flex circuit manufacturing and surface mounting microelectronic components, to metal machining of the metal trigger to epoxy fastening components and CNC machine operations.

The TRAM weapon accessory management system 60 can be used by military, law enforcement or civilian personnel. The multitude of devices that can be fastened to the Picatinny Rails 20 of these carbines or rifles 12 all have to be activated in some fashion. A person involved in using a weapon with a Picatinny rail mounted accessory will use the TRAMS 60 of the present invention to activate and deactivate the weapon accessories with considerable improvement in simple ergonomic requirements. The trigger finger can now control all aspects of enabler activation without the requirement of moving the hand.

Minimization of Infra-Red signature is a highly sought after goal by the United States Military and our system allows this capability. A sniper conducting night precision shooting operations with the TRAMS 60 of the present invention would be able to see a target, activate his/her infra-red illuminator for image enhancement facilitating friend/foe decisions, and then be able to take the shot or extinguish the IR signature with much greater speed. Vibrations caused by non-shooting hand squeeze switches are eliminated. The need to use the non-shooting hand for activating the accessories is eliminated, freeing up the shooter's non-shooting hand for butt-stock manipulation for fine aiming adjustments.

The sniper can activate his own covert illumination device highlighting a potential target for the spotter's confirmation of friend/foe decision. The shot can be taken with unprecedented speed and IR signature minimized with the increased speed of target sighting, illumination, friend/foe determination, and IR signature deactivation.

Close Quarter Battle survivability is enhanced due to the capability of keeping all accessories off until the exact moment you need them for target acquisition via trigger activation. Extremely fast targeting of the enemy is allowed with the trigger finger activation of lasers and illuminators.

Trigger finger activation can be used with any device that requires the index finger activation of any mechanical or electronic device. The MRAM 80 allows placement of two buttons 84 in direct proximity with the shooter's trigger finger for rapid trigger finger activation of the preselected accessories. The button 84 placement frees up the shooter's non shooting hand for other mission requirements such as butt-stock manipulation for fine aim adjustment.

As can be seen, therefore, the present invention includes the following inventive embodiments among others:

1. An accessory management system for managing one or more electrically powered accessories associated with a firearm, said accessory rail management system comprising: a control module, said control module comprising: (a) a housing for fastening the control module to the firearm; (b) a plurality of jacks configured to receive one or more control cords of the one or more accessories; and (c) a switch configured to allow selective operation of the one or more accessories.

2. A system according to any of the preceding embodiments 1: wherein the firearm comprises a rail configured for mounting the one or more accessories; and wherein the housing comprises a clamp for releasably attaching to the rail.

3. A system according to any of the preceding embodiments: wherein the switch comprises a rotary switch; wherein the rotary switch comprises a plurality of settings for selectively activating the one or more accessories; and wherein at least one of the plurality of settings is configured for simultaneously operating at least two of the one or more accessories.

4. A system according to any of the preceding embodiments, further comprising: one or more toggle switches coupled to the rotary switch; wherein the one or more toggle switches comprise independent switching for operation of each of the one or more accessories.

5. A system according to any of the preceding embodiments, wherein the rotary switch and one or more toggle switches are retained in a waterproof enclosure within said housing.

6. A system according to any of the preceding embodiments, wherein the waterproof enclosure comprises a moveable lid configured to allow access to the one or more toggle switches.

7. A system according to any of the preceding embodiments, further comprising: a circuit board coupled to the rotary switch and one or more toggle switches; wherein the circuit board is configured to control operation of the one or more accessories independent of the polarity of the one or more accessories.

8. A system according to any of the preceding embodiments, further comprising: a remote activation module coupled to the control module; the remote activation module being configured to operate at a location spaced apart from the control module; and the remote activation module comprising a retractable element configured to generate a control signal for operation of the one or more accessories.

9. A system according to any of the preceding embodiments, wherein the remote activation module comprises a magazine housing having an opening configured to be received over and attach to a magazine well of the firearm.

10. A system according to any of the preceding embodiments: wherein the remote activation module comprises a flex circuit coupled to the retractable element; and wherein the flex circuit is configured to receive and transmit said control signal.

11. A system according to any of the preceding embodiments, wherein the retractable element comprises a button disposed within said magazine housing at a location accessible to a finger or thumb of the user while operating the firearm.

12. A system according to any of the preceding embodiments, wherein the retractable element further comprises a touch detection tab pivotably coupled to a trigger of the firearm.

13. A system according to any of the preceding embodiments: wherein the touch detection tab comprises a magnet; wherein the flex circuit is coupled to a hall effect sensor; wherein the hall effect sensor is configured to detect motion of the touch detection tab to generate the control signal.

14. A system according to any of the preceding embodiments, wherein the touch detection tab is disposed within a slot of the trigger.

15. A system according to any of the preceding embodiments, further comprising a clasp: wherein the clasp comprises a clamp configured to releasably attach to the rail; the clasp comprising one or more slots for retaining the one or more power cords.

16. A system according to any of the preceding embodiments, wherein the accessories comprise one or more of a laser, light, and IR illuminator; wherein the accessories are mounted to the rail.

17. An apparatus for managing one or more electrically powered accessories associated with a firearm, the firearm comprising a rail configured for mounting the one or more accessories, comprising: a control module, comprising: (a) a housing for fastening the control module to the firearm, the housing comprising a clamp for releasably attaching to the rail; (b) a plurality of jacks configured to receive one or more control cords of the one or more accessories; and (c) a switch configured to allow selective operation of the one or more accessories.

18. An apparatus according to any of the preceding embodiments: wherein the switch comprises a rotary switch; wherein the rotary switch comprises a plurality of settings for selectively activating the one or more accessories; and wherein at least one of the plurality of settings is configured for simultaneously operating at least two of the one or more accessories.

19. An apparatus according to any of the preceding embodiments, further comprising: one or more toggle switches coupled to the rotary switch; wherein the one or more toggle switches comprise independent switching for operation of each of the one or more accessories.

20. An apparatus according to any of the preceding embodiments, further comprising: a circuit board coupled to the switch; wherein the circuit board is configured to control operation of the one or more accessories independent of the polarity of the one or more accessories.

21. An apparatus according to any of the preceding embodiments, further comprising: a remote activation module coupled to the control module; the remote activation module being configured to operate at a location spaced apart from the control module; and the remote activation module comprising a retractable element configured to generate a control signal for operation of the one or more accessories.

22. An apparatus according to any of the preceding embodiments, wherein the remote activation module comprises a magazine housing having an opening configured to be received over and attach to a magazine well of the firearm.

23. An apparatus according to any of the preceding embodiments: wherein the remote activation module comprises a flex circuit coupled to the retractable element; and wherein the flex circuit is configured to receive and transmit said control signal.

24. An apparatus according to any of the preceding embodiments, wherein the retractable element comprises a button disposed within said magazine housing at a location accessible to a finger or thumb of the user while operating the firearm.

25. An apparatus according to any of the preceding embodiments, wherein the retractable element further comprises a touch detection tab pivotably coupled to a trigger of the firearm.

26. An apparatus according to any of the preceding embodiments: wherein the touch detection tab comprises a magnet; wherein the flex circuit is coupled to a hall effect sensor; wherein the hall effect sensor is configured to detect motion of the magnet to generate the control signal.

27. An apparatus according to any of the preceding embodiments, wherein the touch detection tab is disposed within a slot of the trigger.

28. An apparatus according to any of the preceding embodiments, further comprising a clasp: wherein the clasp comprises a clamp configured to releasably attach to the rail; the clasp comprising one or more slots for retaining the one or more power cords.

29. An apparatus according to any of the preceding embodiments, wherein the accessories comprise one or more of a laser, light, and IR illuminator; wherein the accessories are mounted to the rail.

30. A clasp for managing one or more accessory control cords associated with one or more accessories coupled to a rail of a firearm comprising: a clamp section configured to releasably attach to the rail; and a retainer section comprising one or more slots for retaining the one or more power cords.

31. A clasp according to any of the preceding embodiments, further comprising: a foldable cap configured to be folded over the retainer section to house the one or more cords within the retaining section.

32. A clasp according to any of the preceding embodiments, further comprising: a tab coupled to the foldable cap;

wherein the tab is configured to engage a slot in the clamp section to lock the position of the tab.

33. An interface circuit for activating and deactivating an electrically powered accessory associated with a firearm, comprising: an input circuit; a driver circuit, said driver circuit having a plurality of outputs, each said output configured for electrical connection to an electrically powered accessory associated with a firearm; a control circuit connected to the input circuit and to the driver circuit, said control circuit including a channel selector switch and a plurality of output line enable switches connected to said channel selector switch; wherein each said output line enable switch is configured for enabling or disabling operation of a corresponding said one of said outputs in said driver circuit; wherein said channel selector switch is configured for selecting one or more enabled outputs in said driver circuit for control by said input switch; and wherein operation of the input circuit causes the driver circuit to activate or deactivate an enabled output selected by said channel selector switch for on-off switching of a said accessory connected to said enabled output.

34. The interface circuit according to any of the preceding embodiments, wherein said input circuit comprises a switch.

35. The interface circuit according to any of the preceding embodiments, wherein said control circuit provides push-on, push-off activation of an enabled output by said switch.

36. The interface circuit according to any of the preceding embodiments, wherein said input circuit further comprises a Hall effect switch operable by a magnet on a touch detection trigger mechanism.

37. The interface circuit according to any of the preceding embodiments, wherein said control circuit provides momentary activation of an enabled output by said switch or said touch detection trigger mechanism.

38. The interface circuit according to any of the preceding embodiments, wherein said outputs in said output circuit are electrically isolated and wherein each said output is configured for electrical connection to a said accessory independent of the polarity of the electrical connections on the accessory.

39. An interface circuit for activating and deactivating an electrically powered accessory associated with a firearm, comprising: an input circuit, said input circuit comprising one or more pushbutton switches; a driver circuit, said driver circuit having a plurality of outputs, each said output configured for electrical connection to an electrically powered accessory associated with a firearm; a control circuit connected to the input circuit and to the driver circuit, said control circuit including a channel selector switch and a plurality of output line enable switches connected to said channel selector switch; wherein each said output line enable switch is configured for enabling or disabling operation of a corresponding said one of said outputs in said driver circuit; wherein said channel selector switch is configured for selecting one or more enabled outputs in said driver circuit for control by said input switch; and wherein operation of a said one of said pushbutton switches in the input circuit causes the driver circuit to activate or deactivate an enabled output selected by said channel selector switch for on-off switching of a said accessory connected to said enabled output.

40. The interface circuit according to any of the preceding embodiments, wherein said control circuit provides push-on, push-off activation of an enabled output by a said pushbutton switch.

41. The interface circuit according to any of the preceding embodiments, wherein said input circuit further comprises a Hall effect switch operable by a magnet on a touch detection trigger mechanism.

42. The interface circuit according to any of the preceding embodiments, wherein said control circuit provides momentary activation of an enabled output by a said pushbutton or said touch detection trigger mechanism.

43. The interface circuit according to any of the preceding embodiments, wherein said outputs in said output circuit are electrically isolated and wherein each said output is configured for electrical connection to a said accessory independent of the polarity of the electrical connections on the accessory.

44. An interface circuit for activating and deactivating an electrically powered accessory associated with a firearm, comprising: an input circuit, said input circuit comprising one or more pushbutton switches, said input circuit comprising a Hall effect switch operable by a magnet on a touch detection trigger mechanism; a driver circuit, said driver circuit having a plurality of outputs, each said output configured for electrical connection to an electrically powered accessory associated with a firearm; a control circuit connected to the input circuit and to the driver circuit, said control circuit including a channel selector switch and a plurality of output line enable switches connected to said channel selector switch; wherein each said output line enable switch is configured for enabling or disabling operation of a corresponding said one of said outputs in said driver circuit; wherein said channel selector switch is configured for selecting one or more enabled outputs in said driver circuit for control by said input switch; and wherein operation of a said one of said pushbutton switches or said Hall effect switch in the input circuit causes the driver circuit to activate or deactivate an enabled output selected by said channel selector switch for on-off switching of a said accessory connected to said enabled output.

45. The interface circuit according to any of the preceding embodiments, wherein said control circuit provides momentary activation of an enabled output by a said pushbutton.

46. The interface circuit according to any of the preceding embodiments, wherein said outputs in said output circuit are electrically isolated and wherein each said output is configured for electrical connection to a said accessory independent of the polarity of the electrical connections on the accessory.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An accessory management system for managing one or more electrically powered accessories associated with a firearm, said accessory management system comprising:

a control module, said control module comprising:

(a) a housing for fastening the control module to the firearm;

(b) a plurality of jacks configured to receive one or more control cords of the one or more accessories; and (c) a switch configured to allow selective operation of the one or more accessories;

wherein the switch comprises a rotary switch;

wherein the rotary switch comprises a plurality of settings for selectively activating the one or more accessories; and wherein at least one of the plurality of settings is configured for simultaneously operating at least two of the one or more accessories.

2. A system as recited in claim 1:

wherein the firearm comprises a rail configured for mounting the one or more accessories; and wherein the housing comprises a clamp for releasably attaching to the rail.

3. A system as recited in claim 1, further comprising:

one or more toggle switches coupled to the rotary switch;

wherein the one or more toggle switches comprise independent switching for operation of each of the one or more accessories.

4. A system as recited in claim 3, wherein the rotary switch and one or more toggle switches are retained in a waterproof enclosure within said housing.

5. A system as recited in claim 4, wherein the waterproof enclosure comprises a moveable lid configured to allow access to the one or more toggle switches.

6. A system as recited in claim 3, further comprising:

a circuit board coupled to the rotary switch and one or more toggle switches;

wherein the circuit board is configured to control operation of the one or more accessories independent of the polarity of the one or more accessories.

7. An accessory management system for managing one or more electrically powered accessories associated with a firearm, said accessory management system comprising:

a control module, said control module comprising:

(a) a housing for fastening the control module to the firearm;

(b) a plurality of jacks configured to receive one or more control cords of the one or more accessories; and (c) a switch configured to allow selective operation of the one or more accessories; and a remote activation module coupled to the control module;

the remote activation module being configured to operate at a location spaced apart from the control module; and the remote activation module comprising a retractable element configured to generate a control signal for operation of the one or more accessories.

8. A system as recited in claim 7, wherein the remote activation module comprises a magazine housing having an opening configured to be received over and attach to a magazine well of the firearm.

9. A system as recited in claim 8:

wherein the remote activation module comprises a flex circuit coupled to the retractable element; and wherein the flex circuit is configured to receive and transmit said control signal.

10. A system as recited in claim 9, wherein the retractable element comprises a button disposed within said magazine housing at a location accessible to a finger or thumb of the user while operating the firearm.

11. A system as recited in claim 10, wherein the retractable element further comprises a touch detection tab pivotably coupled to a trigger of the firearm.

12. A system as recited in claim 11:

wherein the touch detection tab comprises a magnet;

wherein the flex circuit is coupled to a hall effect sensor;

wherein the hall effect sensor is configured to detect motion of the touch detection tab to generate the control signal.

13. A system as recited in claim 11, wherein the touch detection tab is disposed within a slot of the trigger.

14. A system as recited in claim 2, further comprising a clasp:

wherein the clasp comprises a clamp configured to releasably attach to the rail;

the clasp comprising one or more slots for retaining the one or more power cords.

15. A system as recited in claim 2, wherein the accessories comprise one or more of a laser, light, and IR illuminator;

wherein the accessories are mounted to the rail.

16. An apparatus for managing one or more electrically powered accessories associated with a firearm, the firearm comprising a rail configured for mounting the one or more accessories, comprising:

a control module, comprising:

(a) a housing for fastening the control module to the firearm, the housing comprising a clamp for releasably attaching to the rail.

(b) a plurality of jacks configured to receive one or more control cords of the one or more accessories; and (c) a switch configured to allow selective operation of the one or more accessories;

wherein the switch comprises a rotary switch;

wherein the rotary switch comprises a plurality of settings for selectively activating the one or more accessories; and wherein at least one of the plurality of settings is configured for simultaneously operating at least two of the one or more accessories.

17. An apparatus as recited in claim 16, further comprising:

one or more toggle switches coupled to the rotary switch;

wherein the one or more toggle switches comprise independent switching for operation of each of the one or more accessories.

18. An apparatus as recited in 16, further comprising:

a circuit board coupled to the switch;

wherein the circuit board is configured to control operation of the one or more accessories independent of the polarity of the one or more accessories.

19. An apparatus for managing one or more electrically powered accessories associated with a firearm, the firearm comprising a rail configured for mounting the one or more accessories, comprising:

a control module, comprising:

(a) a housing for fastening the control module to the firearm, the housing comprising a clamp for releasably attaching to the rail.

(b) a plurality of jacks configured to receive one or more control cords of the one or more accessories; and (c) a switch configured to allow selective operation of the one or more accessories;

a remote activation module coupled to the control module;

the remote activation module being configured to operate at a location spaced apart from the control module; and the remote activation module comprising a retractable element configured to generate a control signal for operation of the one or more accessories.

20. An apparatus as recited in claim 19, wherein the remote activation module comprises a magazine housing having an opening configured to be received over and attach to a magazine well of the firearm.

21. An apparatus as recited in claim 20:

wherein the remote activation module comprises a flex circuit coupled to the retractable element; and wherein the flex circuit is configured to receive and transmit said control signal.

22. An apparatus as recited in claim 21, wherein the retractable element comprises a button disposed within said magazine housing at a location accessible to a finger or thumb of the user while operating the firearm.

23. An apparatus as recited in claim 22, wherein the retractable element further comprises a touch detection tab pivotably coupled to a trigger of the firearm.

24. An apparatus as recited in claim 23:

wherein the touch detection tab comprises a magnet;

wherein the flex circuit is coupled to a hall effect sensor;

wherein the hall effect sensor is configured to detect motion of the magnet to generate the control signal.

25. An apparatus as recited in claim 23, wherein the touch detection tab is disposed within a slot of the trigger.

26. An apparatus as recited in claim 16, further comprising:

a clasp;

wherein the clasp comprises a clamp configured to releasably attach to the rail;

the clasp comprising one or more slots for retaining the one or more power cords.

27. An apparatus as recited in claim 16:

wherein the accessories comprise one or more of a laser, light, and IR illuminator; and wherein the accessories are mounted to the rail.

* * * * *